US005182549A

United States Patent [19]

Taniguchi et al.

[11] Patent Number: 5,182,549

[45] Date of Patent: Jan. 26, 1993

[54] LIQUID CRYSTAL APPARATUS

[75] Inventors: Osamu Taniguchi, Chigasaki; Hiroshi Inoue, Yokohama; Atsushi Mizutome, Fujisawa; Tadashi Mihara, Atsugi; Yoshihiro Onitsuka, Yokohama; Masahiro Terada, Atsugi, all of Japan

[73] Assignee: Canon Kabushiki Kaisha, Tokyo, Japan

[21] Appl. No.: 164,504

[22] Filed: Mar. 4, 1988

[30] Foreign Application Priority Data

| | | | |
|---|---|---|---|
| Mar. 5, 1987 | [JP] | Japan | 62-51775 |
| Mar. 31, 1987 | [JP] | Japan | 62-78003 |
| Jun. 8, 1987 | [JP] | Japan | 62-143874 |
| Jul. 27, 1987 | [JP] | Japan | 62-188298 |

[51] Int. Cl.[5] ..... G09G 3/36

[52] U.S. Cl. ..... 340/784; 340/805; 358/236

[58] Field of Search ..... 340/765, 784, 805; 350/331 R, 350 S, 332, 333; 358/236; 359/54

[56] References Cited

U.S. PATENT DOCUMENTS

| | | | |
|---|---|---|---|
| 4,635,129 | 1/1987 | Togashi | 358/236 |
| 4,638,310 | 1/1987 | Ayliffe | 340/805 |
| 4,655,561 | 4/1987 | Kanbe et al. | 350/350 |
| 4,693,563 | 9/1987 | Harada et al. | 350/350 |
| 4,701,026 | 10/1987 | Yazaki et al. | 350/333 |
| 4,701,799 | 10/1987 | Yoshimura | 340/784 |
| 4,711,531 | 12/1987 | Masubuchi | 350/350 |
| 4,715,688 | 12/1987 | Harada et al. | 350/350 |
| 4,725,129 | 2/1988 | Kondo et al. | 350/350 |
| 4,770,502 | 9/1988 | Kitazima | 350/350 |
| 4,800,382 | 1/1989 | Okada et al. | 340/784 |
| 4,836,656 | 6/1989 | Mouri et al. | 350/350 S |

FOREIGN PATENT DOCUMENTS

| | | |
|---|---|---|
| 0177365 | 4/1986 | European Pat. Off. . |
| 3529376 | 2/1986 | Fed. Rep. of Germany . |
| 2173336 | 10/1986 | United Kingdom . |
| 2178581 | 2/1987 | United Kingdom . |

*Primary Examiner*—Ulysses Weldon
*Assistant Examiner*—M. Fatahiyan
*Attorney, Agent, or Firm*—Fitzpatrick, Cella, Harper & Scinto

[57] ABSTRACT

In a liquid crystal apparatus the scanning electrodes are applied with at least two scanning selection signals in at least two vertical scanning periods. The scanning selection signals comprise mutually different waveforms, each comprising a pulse of one or the opposite voltage polarity with respect to the level of a voltage applied to a scanning electrode when it is not selected. Data pulses are applied to the data electrodes in phase with the pulse. A writing voltage and a fore voltage are applied prior to the writing voltage formed by the combination of the pulse and a data voltage to a pixel on a scanning electrode during a selection period determined by application of the one or the opposite polarity to the scanning electrode. The fore voltage pulse has a polarity opposite to that of the writing voltage and an amplitude which is ½ or less of that of the writing voltage.

17 Claims, 30 Drawing Sheets

| | | ODD FRAME $F_{2M-1}$ (M=1,2,3···) | | EVEN FRAME $F_{2M}$ (M=1,2,3···) | |
|---|---|---|---|---|---|
| SCAN SELECTION SIGNAL (ODD) $S_{2n-1}$ (n=1,2,3···) | | 2Vo, 0, -2Vo | | 2Vo, 0, -2Vo | |
| SCAN SELECTION SIGNAL (EVEN) $S_{2n}$ (n=1,2,3···) | | 2Vo, 0, -2Vo | | 2Vo, 0, -2Vo | |
| SCAN NONSELECTION SIGNAL | | 0 | | 0 | |
| INFORMATION SIGNAL | IN PHASE WITH $S_{2n-1}$ | "W" | Vo, 0, -Vo | "B" | Vo, 0, -Vo |
| | | "H" | Vo, 0, -Vo | "H" | Vo, 0, -Vo |
| | IN PHASE WITH $S_{2n}$ | "B" | Vo, 0, -Vo | "W" | Vo, 0, -Vo |
| | | "H" | Vo, 0, -Vo | "H" | Vo, 0, -Vo |

FIG. 7

| | | ODD FRAME $F_{2M-1}$ (M=1,2,3···) | | EVEN FRAME $F_{2M}$ (M=1,2,3···) | |
|---|---|---|---|---|---|
| SCAN SELECTION SIGNAL (ODD) $S_{2n-1}$ (n=1,2,3···) | | | 2Vo, 0, -2Vo | | 2Vo, 0, -2Vo |
| SCAN SELECTION SIGNAL (EVEN) $S_{2n}$ (n=1,2,3···) | | | 2Vo, 0, -2Vo | | 2Vo, 0, -2Vo |
| SCAN NONSELECTION SIGNAL | | | 0 | | 0 |
| INFORMATION SIGNAL | IN PHASE WITH $S_{2n-1}$ | "W" | Vo, 0, -Vo | "B" | Vo, 0, -Vo |
| | | "H" | Vo, 0, -Vo | "H" | Vo, 0, -Vo |
| | IN PHASE WITH $S_{2n}$ | "B" | Vo, 0, -Vo | "W" | Vo, 0, -Vo |
| | | "H" | Vo, 0, -Vo | "H" | Vo, 0, -Vo |

FIG. 9

| | | ODD FRAME $F_{2M-1}$ (M=1,2,3···) | | EVEN FRAME $F_{2M}$ (M=1,2,3···) | |
|---|---|---|---|---|---|
| SCAN SELECTION SIGNAL (ODD) $S_{2n-1}$ (n=1,2,3···) | | 2Vo, 0, -2Vo | | 2Vo, 0, -2Vo | |
| SCAN SELECTION SIGNAL (EVEN) $S_{2n}$ (n=1,2,3···) | | 2Vo, 0, -2Vo | | 2Vo, 0, -2Vo | |
| SCAN NONSELECTION SIGNAL | | 0 | | 0 | |
| INFORMATION SIGNAL | IN PHASE WITH $S_{2n-1}$ | "W" | Vo, 0, -Vo | "B" | Vo, 0, -Vo |
| | | "H" | Vo, 0, -Vo | "H" | Vo, 0, -Vo |
| | IN PHASE WITH $S_{2n}$ | "B" | Vo, 0, -Vo | "W" | Vo, 0, -Vo |
| | | "H" | Vo, 0, -Vo | "H" | Vo, 0, -Vo |

FIG. 11

| | | ODD FRAME $F_{2M-1}$ (M=1,2,3···) | | EVEN FRAME $F_{2M}$ (M=1,2,3···) | |
|---|---|---|---|---|---|
| SCAN SELECTION SIGNAL (ODD) $S_{2n-1}$ (n=1,2,3···) | | | 0, −2Vo | | 2Vo, 0 |
| SCAN SELECTION SIGNAL (EVEN) $S_{2n}$ (n=1,2,3···) | | | 2Vo, 0 | | 0, −2Vo |
| SCAN NONSELECTION SIGNAL | | | 0 | | 0 |
| INFORMATION SIGNAL | IN PHASE WITH $S_{2n-1}$ | "W" | Vo, 0 | "B" | 0, −Vo |
| | | "H" | 0, −Vo | "H" | Vo, 0 |
| | IN PHASE WITH $S_{2n}$ | "B" | 0, −Vo | "W" | Vo, 0 |
| | | "H" | Vo, 0 | "H" | 0, −Vo |

FIG. 12

| | | ODD FRAME $F_{2M-1}$ (M=1,2,3··· ) | | EVEN FRAME $F_{2M}$ (M=1,2,3··· ) | |
|---|---|---|---|---|---|
| SCAN SELECTION SIGNAL $S_A$ TO (4N-3)th AND (4N-2)th SCAN ELECTRODES (N=1,2,3··· ) | | 2Vo, 0, -2Vo | | 2Vo, 0, -2Vo | |
| SCAN SELECTION SIGNAL $S_B$ TO (4N-1)th AND 4Nth SCAN ELECTRODES (N=1,2,3··· ) | | 2Vo, 0, -2Vo | | 2Vo, 0, -2Vo | |
| SCAN NONSELECTION SIGNAL | | 0 | | 0 | |
| INFORMATION SIGNAL | IN PHASE WITH $S_A$ | "W" | Vo, 0, -Vo | "B" | Vo, 0, -Vo |
| | | "H" | Vo, 0, -Vo | "H" | Vo, 0, -Vo |
| | IN PHASE WITH $S_B$ | "B" | Vo, 0, -Vo | "W" | Vo, 0, -Vo |
| | | "H" | Vo, 0, -Vo | "H" | Vo, 0, -Vo |

FIG. 14

| | | ODD FRAME $F_{2M-1}$ (M=1,2,3···) | | EVEN FRAME $F_{2M}$ (M=1,2,3-) | |
|---|---|---|---|---|---|
| SCAN SELECTION SIGNAL $S_A$ TO (6N-5)th, (6N-4)th AND (6N-3)th SCAN ELECTRODES (N=1,2,3···) | | 2Vo 0 -2Vo | | 2Vo 0 -2Vo | |
| SCAN SELECTION SIGNAL $S_B$ TO (6N-2)th, (6N-1)th AND 6N SCAN ELECTRODES (N=1,2,3···) | | 2Vo 0 -2Vo | | 2Vo 0 -2Vo | |
| SCAN NONSELECTION SIGNAL | | 0 | | 0 | |
| INFORMATION SIGNAL | IN PHASE WITH $S_A$ | "W" | Vo 0 -Vo | "B" | Vo 0 -Vo |
| | | "H" | Vo 0 -Vo | "H" | Vo 0 -Vo |
| | IN PHASE WITH $S_B$ | "B" | Vo 0 -Vo | "W" | Vo 0 -Vo |
| | | "H" | Vo 0 -Vo | "H" | Vo 0 -Vo |

FIG. 15

| | | ODD FRAME $F_{2M-1}$ (M=1,2,3···) | | EVEN FRAME $F_{2M}$ (M=1,2,3···) | |
|---|---|---|---|---|---|
| SCAN SELECTION SIGNAL (ODD) $S_{2n-1}$ (n=1,2,3···) | | 2Vo, 0, −2Vo | | 2Vo, 0, −2Vo | |
| SCAN SELECTION SIGNAL (EVEN) $S_{2n}$ (n=1,2,3···) | | 2Vo, 0, −2Vo | | 2Vo, 0, −2Vo | |
| SCAN NONSELECTION SIGNAL | | 0 | | 0 | |
| INFORMATION SIGNAL | IN PHASE WITH $S_{2n-1}$ | "W" | Vo, 0, −Vo | "B" | Vo, 0, −Vo |
| | | "H" | Vo, 0, −Vo | "H" | Vo, 0, −Vo |
| | IN PHASE WITH $S_{2n}$ | "B" | Vo, 0, −Vo | "W" | Vo, 0, −Vo |
| | | "H" | Vo, 0, −Vo | "H" | Vo, 0, −Vo |

FIG. 16

| | | ODD FRAME $F_{2M-1}$ (M=1,2,3···) | | EVEN FRAME $F_{2M}$ (M=1,2,3···) | |
|---|---|---|---|---|---|
| SCAN SELECTION SIGNAL (ODD) $S_{2n-1}$ (n=1,2,3···) | | 2Vo, 0, -2Vo | | 2Vo, 0, -2Vo | |
| SCAN SELECTION SIGNAL (EVEN) $S_{2n}$ (n=1,2,3···) | | 2Vo, 0, -2Vo | | 2Vo, 0, -2Vo | |
| SCAN NONSELECTION SIGNAL | | 0 | | 0 | |
| INFORMATION SIGNAL | IN PHASE WITH $S_{2n-1}$ | "W" | Vo, 0, -Vo | "B" | Vo, 0, -Vo |
| | | "H" | Vo, 0, -Vo | "H" | Vo, 0, -Vo |
| | IN PHASE WITH $S_{2n}$ | "B" | Vo, 0, -Vo | "W" | Vo, 0, -Vo |
| | | "H" | Vo, 0, -Vo | "H" | Vo, 0, -Vo |

FIG. 18

| | | ODD FRAME $F_{2M-1}$ (M=1,2,3···) | | EVEN FRAME $F_{2M}$ (M=1,2,3···) | |
|---|---|---|---|---|---|
| SCAN SELECTION SIGNAL (ODD) $S_{2n-1}$ (n=1,2,3···) | | | 2Vo<br>0<br>-2Vo | | 2Vo<br>0<br>-2Vo |
| SCAN SELECTION SIGNAL (EVEN) $S_{2n}$ (n=1,2,3···) | | | 2Vo<br>0<br>-2Vo | | 2Vo<br>0<br>-2Vo |
| SCAN NONSELECTION SIGNAL | | | 0 | | 0 |
| INFORMATION SIGNAL | IN PHASE WITH $S_{2n-1}$ | "W" | Vo<br>0<br>-Vo | "B" | Vo<br>0<br>-Vo |
| | | "H" | Vo<br>0<br>-Vo | "H" | Vo<br>0<br>-Vo |
| | IN PHASE WITH $S_{2n}$ | "B" | Vo<br>0<br>-Vo | "W" | Vo<br>0<br>-Vo |
| | | "H" | Vo<br>0<br>-Vo | "H" | Vo<br>0<br>-Vo |

FIG. 19

| | | ODD FRAME $F_{2M-1}$ (M=1,2,3··· ) | | EVEN FRAME $F_{2M}$ (M=1,2,3··· ) | |
|---|---|---|---|---|---|
| SCAN SELECTION SIGNAL $S_A$ TO (4N-3)th AND (4N-2)th SCAN ELECTRODES (N=1,2,3··· ) | | 2Vo<br>0<br>-2Vo | | 2Vo<br>0<br>-2Vo | |
| SCAN SELECTION SIGNAL $S_B$ TO (4N-1)th AND 4Nth SCAN ELECTRODES (N=1,2,3··· ) | | 2Vo<br>0<br>-2Vo | | 2Vo<br>0<br>-2Vo | |
| SCAN NONSELECTION SIGNAL | | 0 | | 0 | |
| INFORMATION SIGNAL | IN PHASE WITH $S_A$ | "W" | Vo<br>0<br>-Vo | "B" | Vo<br>0<br>-Vo |
| | | "H" | Vo<br>0<br>-Vo | "H" | Vo<br>0<br>-Vo |
| | IN PHASE WITH $S_B$ | "B" | Vo<br>0<br>-Vo | "W" | Vo<br>0<br>-Vo |
| | | "H" | Vo<br>0<br>-Vo | "H" | Vo<br>0<br>-Vo |

FIG. 20

| | | ODD FRAME $F_{2M-1}$ (M=1,2,3···) | | EVEN FRAME $F_{2M}$ (M=1,2,3···) | |
|---|---|---|---|---|---|
| SCAN SELECTION SIGNAL $S_A$ TO (6N-5)th, (6N-4)th AND (6N-3)th SCAN ELECTRODES (N=1,2,3···) | | 2Vo<br>0<br>-2Vo | | 2Vo<br>0<br>-2Vo | |
| SCAN SELECTION SIGNAL $S_B$ TO (6N-2)th, (6N-1)th AND 6N SCAN ELECTRODES (N=1,2,3···) | | 2Vo<br>0<br>-2Vo | | 2Vo<br>0<br>-2Vo | |
| SCAN NONSELECTION SIGNAL | | 0 | | 0 | |
| INFORMATION SIGNAL | IN PHASE WITH $S_A$ | "W" | Vo<br>0<br>-Vo | "B" | Vo<br>0<br>-Vo |
| | | "H" | Vo<br>0<br>-Vo | "H" | Vo<br>0<br>-Vo |
| | IN PHASE WITH $S_B$ | "B" | Vo<br>0<br>-Vo | "W" | Vo<br>0<br>-Vo |
| | | "H" | Vo<br>0<br>-Vo | "H" | Vo<br>0<br>-Vo |

FIG. 21

LIQUID CRYSTAL APPARATUS

FIELD OF THE INVENTION AND RELATED ART

The present invention relates to a liquid crystal apparatus using a ferroelectric liquid crystal capable of providing a discriminable contrast depending on the direction of an electric field applied thereto.

The use of a liquid crystal device showing bistability has been proposed by Clark and Lagerwall in U.S. Pat. No. 4,367,924; Japanese Patent Application (Kokai) 56-107216. As the bistable liquid crystal, a ferroelectric liquid crystal showing chiral smectic C phase (SmC*) or H phase (SmH*) is generally used. The ferroelectric liquid crystal assumes either a first optically stable state or a second optically stable state in response to an electric field applied thereto and retains the resultant state in the absence of an electric field, this showing a stability. Further, the ferroelectric liquid crystal quickly responds to a charge in electric field, and thus the ferroelectric liquid crystal device is expected to be widely used in the field of a high-speed and memory-type display apparatus, etc.

In case where a pair of substrates constituting the ferroelectric liquid crystal device are respectively provided with groups of stripe electrodes crossing each other on their inside surfaces to provide a matrix display apparatus, the matrix display apparatus can be driven by a multiplex driving method as disclosed in U.S. Pat. Nos. 4,548,476; 4,655,561; U.S. patent application Ser. Nos. 691,761 and 701,765; etc.

However, a ferroelectric liquid crystal device as mentioned above involves a problem that it causes flickering when subjected to multiplexing drive. For example, European patent publication EP-A 149899 discloses a multiplex driving method wherein an AC voltage which reverses its phases for each writing frame is applied, selective writing of "white" (with cross nicols arrange to provide a bright state) is effected in a frame, and selective writing of "black" (with cross nicols arranged to provide a dark state) is effected in a subsequent frame.

In such a driving method, at the time of selective writing of "black" after the selective writing of "white", a pixel selectively written in "white" in a preceding frame is half-selected and is supplied with a voltage which is smaller than the writing voltage but is effective. Accordingly, at the time of selective writing of "black" in the multiplex driving method, selected pixels of "white" forming the background of, e.g., a black letter, are uniformly supplied with a half-selection voltage for each cycle of ½ frame (a half of a vertical scanning period, and the "white" selected pixels change their optical characteristics for a cycle of ½ frame). For this reason, in the case of a display of a black letter in the white background, white selected pixels which are for more than black selected pixels cause flickering. On the other hand, in the case of a display of a white letter in the black background, similar flickering is observed. In the case of an ordinary frame frequency of 30 Hz, the above half-selected voltage is applied at a half frame frequency of 15 Hz, so that the flickering is noticeable to an observer and results in a remarkably degraded display quality.

Another problem of such a multiplexing drive method wherein one picture is formed-through a plurality of writing frame scans is occurrence of an awkward image called "tailing" on the display picture, which is observable when the drive method is applied to a motion picture display as in a television display or letter-scrolling on a screen of a word processor. This problem will be further discussed hereinafter.

SUMMARY OF THE INVENTION

An object of the present invention is to provide a liquid crystal apparatus having an increased voltage margin.

Another object of the present invention is to provide driving apparatus for a display panel having solved a problem of flickering on a display.

Another object of the present invention is to provide a driving apparatus for affording normal motion picture display or scroll display.

According to the present invention, there is provided a liquid crystal apparatus, comprising scanning electrodes and data electrodes intersecting with each other to form a pixel at each intersection, and a ferroelectric liquid crystal disposed between the scanning electrodes and data electrodes; the improvement comprising:

first means for applying to the scanning electrodes at least two scanning selection signals in at least two vertical scanning periods, said at least two scanning selection signals comprising mutually different waveforms and each comprising a pulse of one or the other voltage polarity with respects to the level of a voltage applied a scanning electrode when it is not selected; and second means for applying data pulses to the data electrodes in phase with said pulse of one or the other voltage polarity;

said first means and second means in combination applying a fore voltage pulse to a pixel on a scanning electrode selected by application of said pulse of one or the other voltage polarity prior to each application of a writing voltage formed by combination of said pulse of one or the other polarity and an information pulse, said fore voltage pulse having a polarity opposite to that of the writing voltage and an amplitude which is ½ or less of that of the writing voltage.

According to a second aspect of the present invention, there is provided a driving apparatus, comprising scanning electrodes, scanning-side drive means connected to the scanning electrodes, data electrodes intersecting with the scanning electrodes and data-side drive means connected to the data electrodes; the improvement wherein said scanning-side drive means includes means for supplying a first scanning selection signal and a second scanning selection signal having mutually different voltage waveforms, which are supplied to the scanning electrodes in one vertical scanning period and supplied to one scanning electrode in at least two vertical scanning periods.

According to a third aspect of the present invention, there is provided a driving apparatus, comprising scanning electrodes, scanning-side drive means connected to the scanning electrodes, data electrodes intersecting with the scanning electrodes and data-side drive means connected to the data electrodes; the improvement wherein said scanning-side drive means includes means for subjecting the scanning electrodes to frame scanning respectively with a first scanning selection signal having a voltage of one polarity and a second scanning selection signal having a voltage of the other polarity at the same phase, respectively with respect to the level of a voltage applied to a scanning non-selection line, at least one of the first and second scanning selection signals being used for at least two times of frame scanning to form one picture; and said data side drive means includes means for supplying data signals to the data electrodes in phase with said first and second scanning selection signals.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 7 is a waveform diagram showing another set of driving waveforms used in the invention.

FIG. 9 is a waveform diagram showing still another set of driving waveforms used in the invention.

FIGS. 11 and 12 are waveform diagrams each showing another set of driving waveforms used in the invention;

FIGS. 14 and 15 are waveform diagrams each showing another set of driving waveforms used in the invention;

FIG. 16 is a waveform diagram showing still another set of driving waveforms used in the invention;

FIGS. 18, 19, 20 and 21 are waveform diagrams each showing another set of driving waveforms used in the invention;

DETAILED DESCRIPTION OF PREFERRED EMBODIMENTS

According to our experiments, it has been found that in case where a voltage of one polarity is applied to a particular pixel prior to application of a writing voltage of the other polarity to the pixel, the threshold voltage for the writing of the ferroelectric liquid crystal constituting the pixel is changed depending on the amplitude of the voltage of one polarity (hereinafter sometimes referred to as "reverse-polarity fore pulse" or "reverse-polarity fore voltage").

Figure 1:
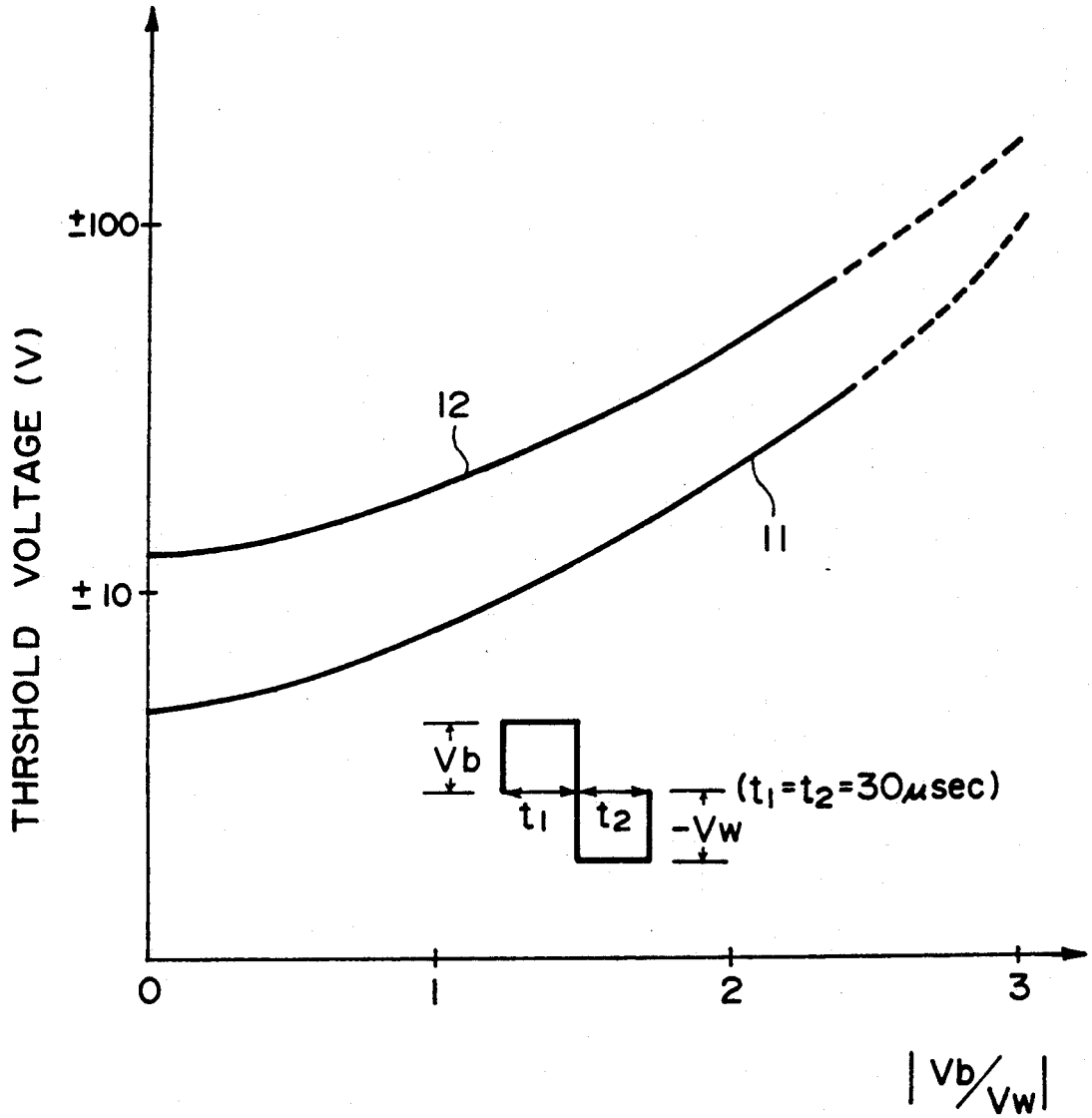
FIG. 1 is a characteristic view showing the influence of a reverse-polarity fore pulse on the threshold voltage of ferroelectric liquid crystals.

FIG. 1 shows the dependency of the threshold voltage Vth of ferroelectric liquid crystal cells on the reverse-polarity fore pulse. The curve 11 represents the threshold characteristic of a ferroelectric liquid crystal cell used in Example 1 described hereinafter, and the curve 12 represents the threshold characteristic of a cell used in Example 2. In FIG. 1, Vb denotes the amplitude of the reverse-polarity fore pulse (This voltage corresponds to a clearing voltage); Vw denotes the amplitude of the writing pulse; and $t_1$ and $t_2$ ($t_1=t_2=30$ μsec) denote the durations of the respective pulses.

FIG. 1 shows that the threshold voltage steeply increases as the amplitude Vb of the reverse-polarity fore pulse is increased.

As a result of further experiments of ours, it has been found that the influence of the reverse-polarity fore pulse at the time of writing can be minimized if the amplitude thereof (Vb) is set to $\frac{1}{2}$ or below, preferably $\frac{1}{3}$ or below, of the amplitude of the writing pulse (Vw).

Figure 2:
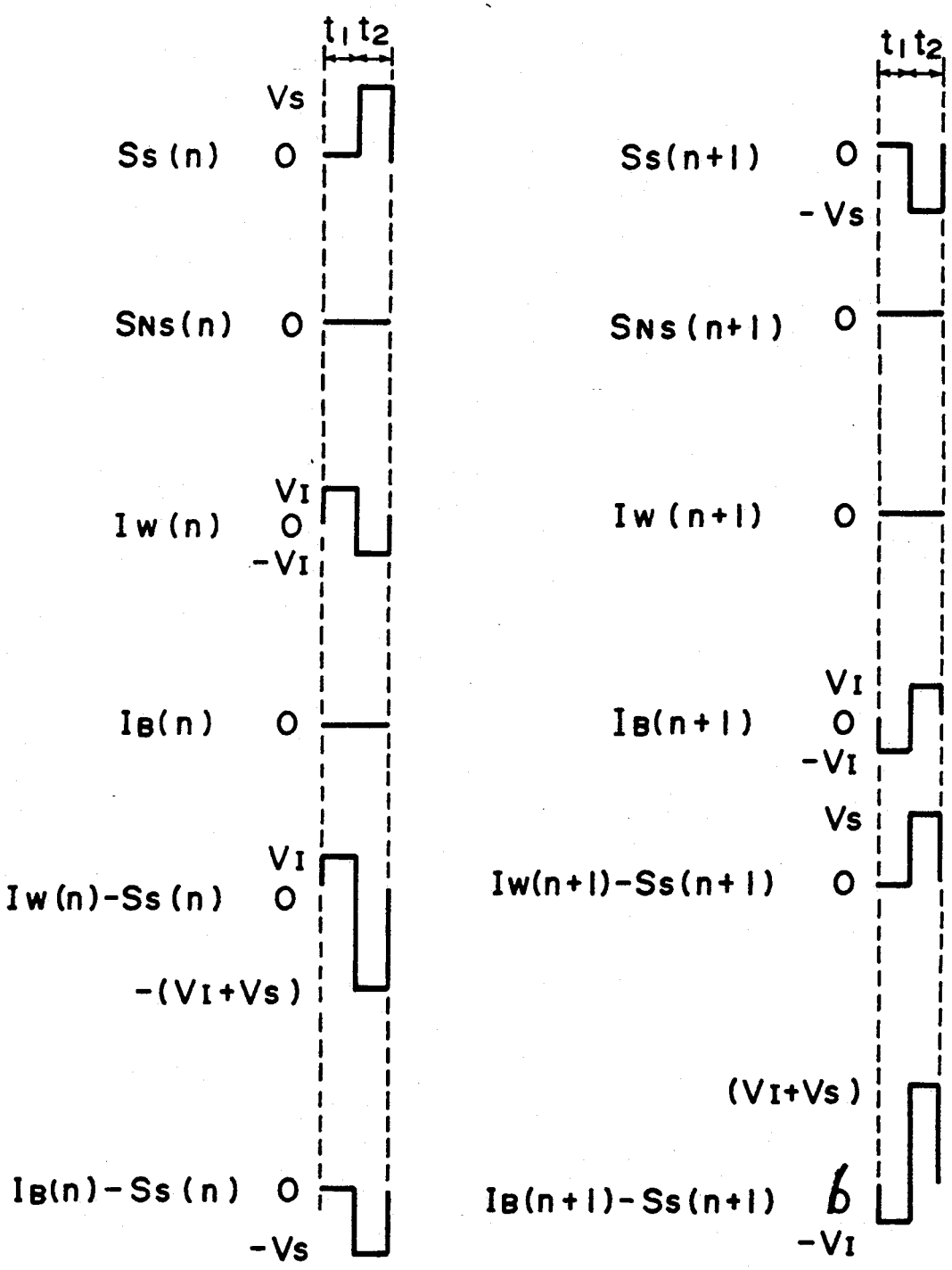
FIGS. 2 and 3 are waveform diagrams of driving voltages used in multiplexing drive according to the present invention.
Figure 3:
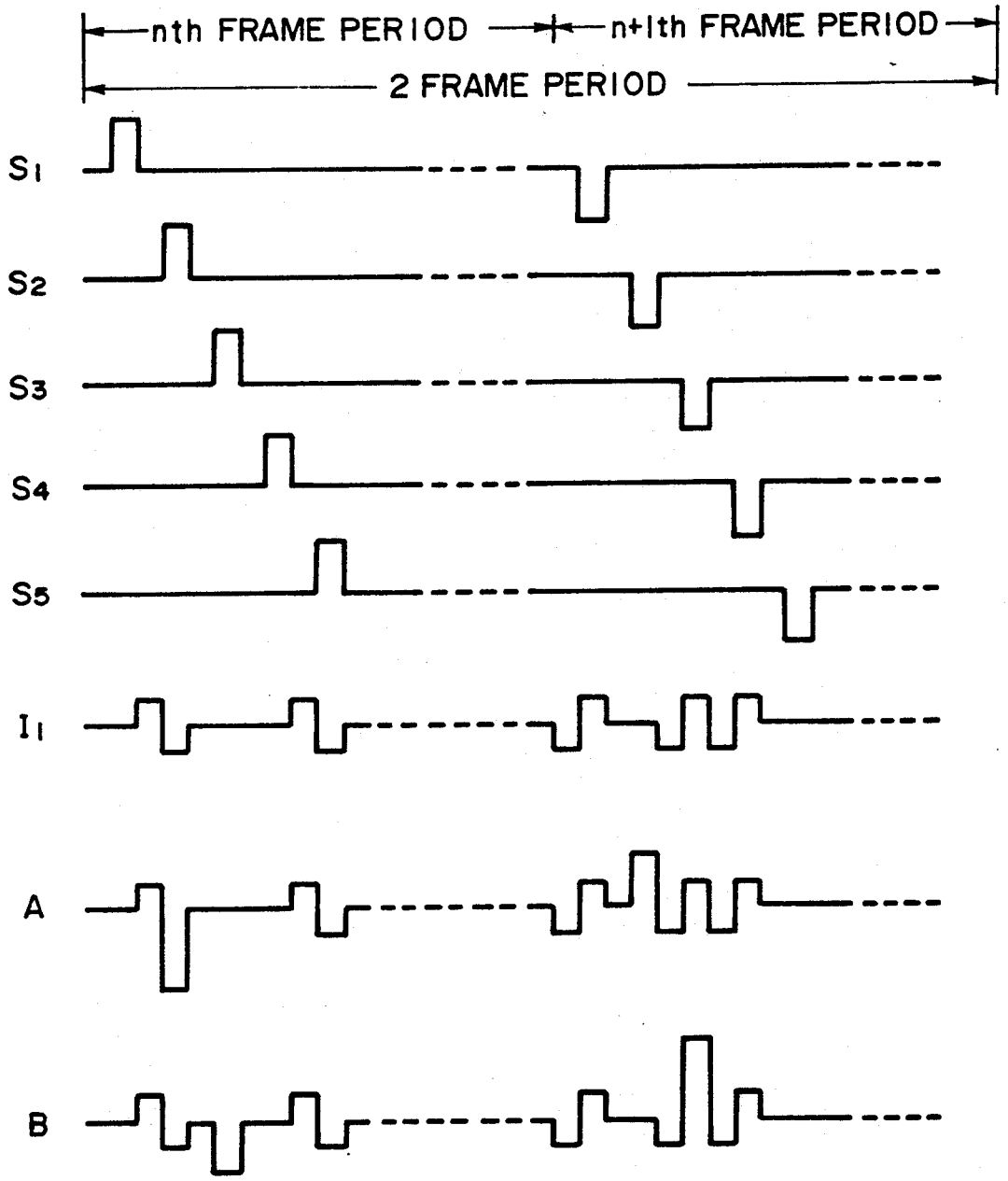

FIG. 2 shows a set of driving signal waveforms used in a preferred driving embodiment of the invention, and FIG. 3 is a time-serial waveform diagram using the driving signals. In FIG. 2 and similar figures described hereinafter, a signal followed by (n) is one applied in an n-th frame and a signal followed by (n+1) is one applied in an (n+1)th frame. A picture is formed in two frames. $S_S$ denotes a scanning selection signal; $S_{NS}$, a scanning nonselection signal; $I_W$, a "white"-writing signal, and $I_B$, a "black"-writing signal.

In this driving embodiment, in order to prevent the above-mentioned influence of the fore pulse, a reset operation of preliminarily bringing all the pixels on a selected scanning line uniformly to, e.g., the "white" (or "bright") state is not effected, but one picture is displayed in two frames wherein, for example, the white state is written in desired pixels in the first frame and pixels to be written in "black" are then written as such in the subsequent second frame while the polarity of the scanning signal is reversed. In this driving embodiment, "white" is written in an n-th frame (n is an integer) and "black" is written in the subsequent (n+1)th frame. The waveforms of driving signals and voltages applied to pixels in the respective frames are as shown in the figures. By selectively applying the information signals in the respective frames, crosstalk based on the influence of a reverse-polarity fore pulse can be obviated.

Figure 4:
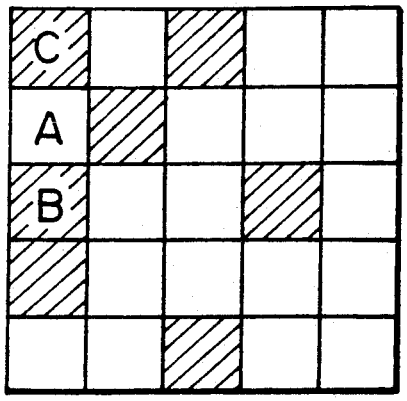
FIG. 4 is a plan view showing a display example.

FIG. 3 show time-serial waveforms of scanning signals $S_1, S_2, \ldots, S_5$, an information or data signal $I_1$, a voltage $(I_1-S_2)$ applied to a pixel A and a voltage $(I_1-S_3)$ applied to a pixel B for providing a display pixel pattern shown in FIG. 4.

In this instance, the voltage levels of the respective signals may be set to satisfy the following relationship:

$$|V_S + V_I| > V_{sat}^0$$
$$|V_S - V_I| < V_{th}^0$$

The above-mentioned liquid crystal cells were driven under the following conditions to provide very good images:

Environmental temperature: 30° C.

Driving pulse duration: $\Delta t=(t_1=t_2)=30$ μsec

Driving voltage: $|V_S+V_I|=24$ volts

Bias ratio: $|V_S+V_I|/|V_I|=3$

Figure 5:
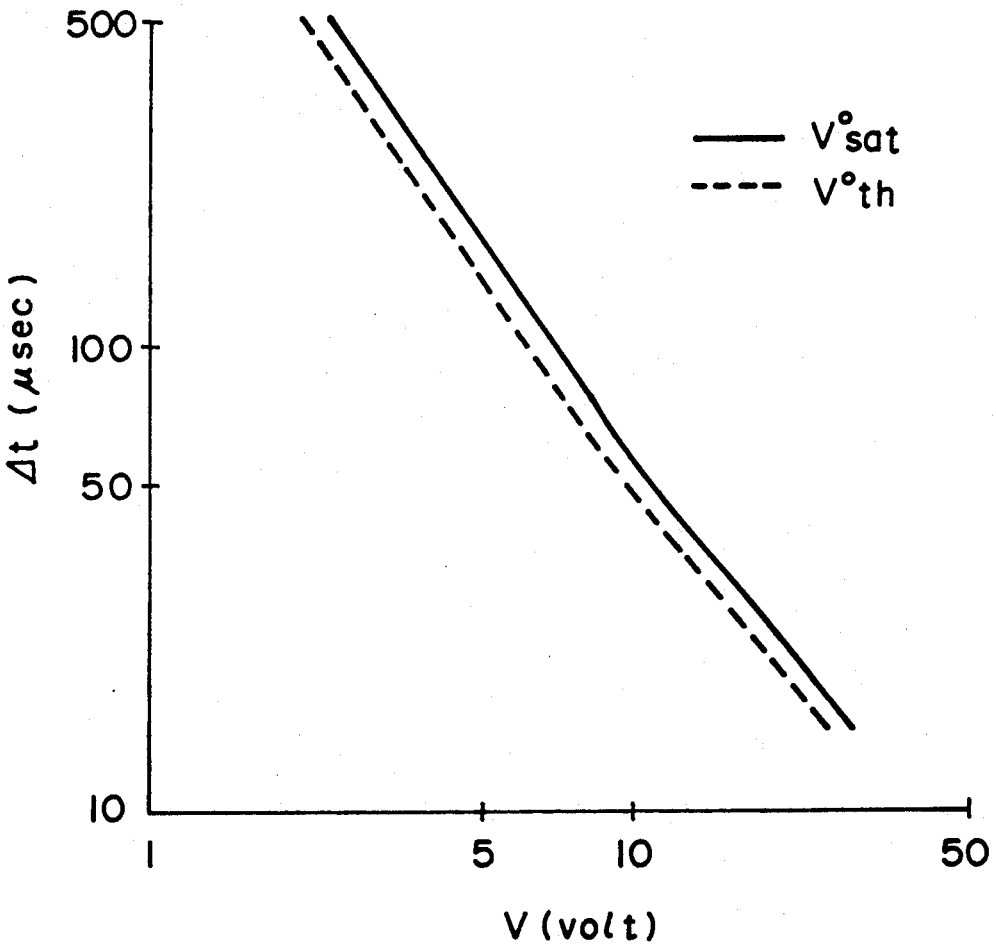
FIG. 5 is a characteristic view showing the dependence of the threshold voltage of a ferroelectric liquid crystal device on the pulse duration.

FIG. 5 shows the dependence of the threshold voltage on the pulse duration when a single pulse with a pulse duration Δt was applied a ferroelectric liquid crystal cell used in Example 1 described hereinafter. Herein, $$V_{th}^0$$

denotes a voltage causing an inversion at a part of a pixel (250 μm×250 μm), and $$V_{sat}^0$$

denotes a voltage causing an inversion over the entire region of a pixel.

Figure 6:
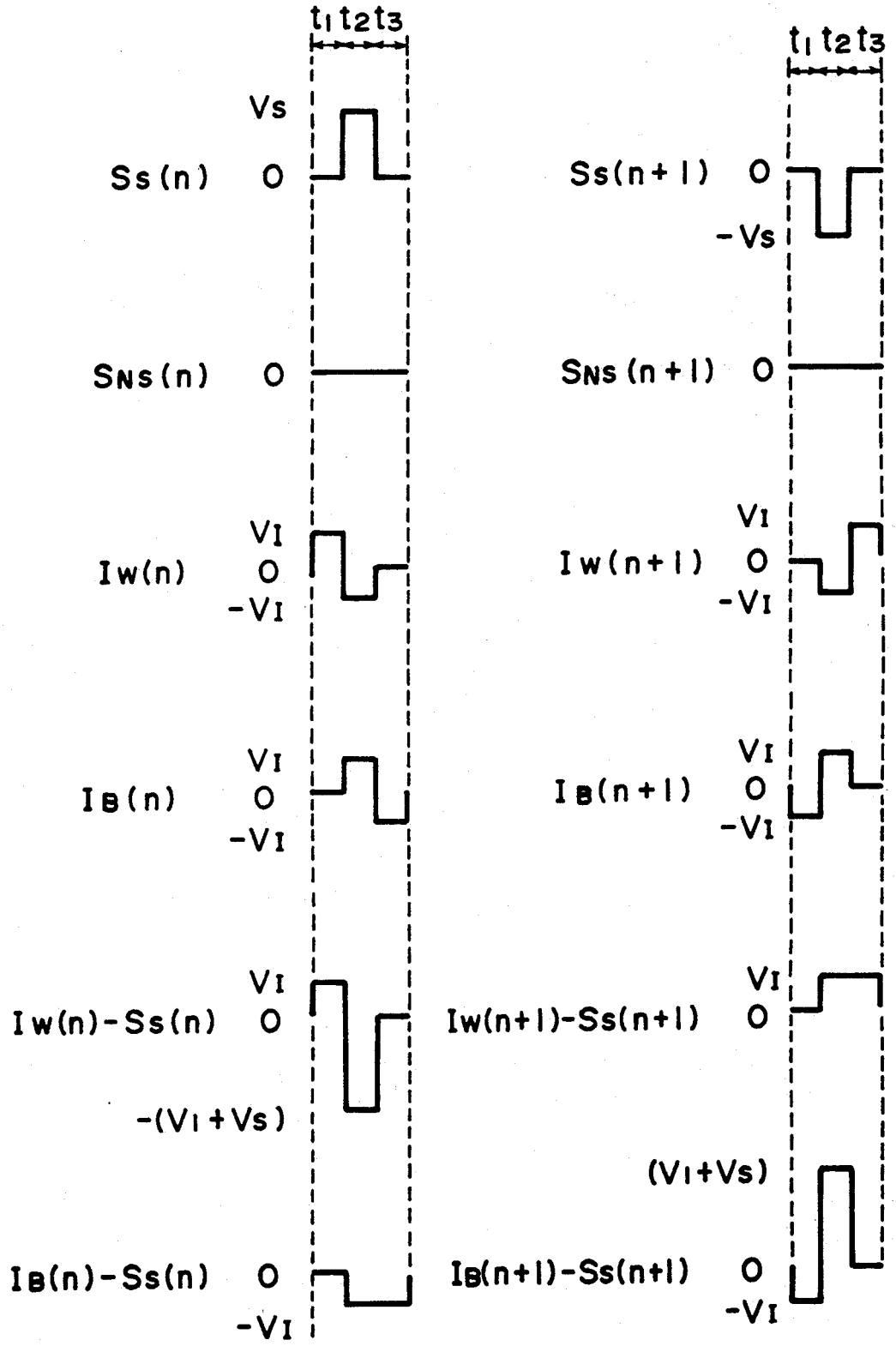
FIG. 6 is a waveform diagram showing another preferred set of driving waveforms.

FIG. 6 shows a set of driving waveforms in another driving embodiment. In FIG. 6, (n) and (n+1), etc., have the same meanings as in FIG. 2. In this driving embodiment, different information or data signals are used for the same data in two successive scans. Further, in the two successive scans, the information signals providing the same data are applied at different instants or phases in a scanning selection period or have mutually opposite polarities.

In the liquid crystal apparatus of the present invention, a particular pixel showing the same display state is supplied with DC voltage components of mutually opposite polarities in an n-th frame period and in an (n+1)th frame period, and the voltages applied to the pixel assume zero on a time-average, i.e., as a time-weighted average, during the period of two frames.

FIG. 7 shows another set of driving waveforms used in the invention. More specifically, FIG. 7 shows a scanning selection signal $S_{2n-1}$ (n=1, 2, 3 . . . ) applied to an odd-numbered scanning electrode and a scanning selection signal. $S_{2n}$ applied to an even-numbered scanning electrode in both an odd-numbered frame $F_{2M-1}$ and an even-numbered frame $F_{2M}$. In FIG. 7 and subsequent similar figures; "W" denotes a white signal, "B" denotes a black signal, and "H" denotes a hold signal for retaining the previous state. According to FIG. 7, the scanning selection signal $S_{2n-1}$ has mutually opposite voltage polarities (i.e., voltage polarities with respect to the voltage of the scanning nonselection signal) in the odd frame $F_{2M-1}$ and the even frame $F_{2M}$. This also holds true with the scanning selection signal $S_{2n}$. Further, the scanning selection signals $S_{2n-1}$ and $S_{2n}$ applied in one frame period have mutually different voltage waveforms and have mutually opposite voltage polarities in a single phase.

Further, in the driving embodiment shown in FIG. 7, a third phase for having the whole picture pose (e.g. by applying a zero voltage to all the pixels constituting the picture) is provided and the third phase for each scanning selection signal is set to a zero voltage (the same voltage level as the scanning nonselection signal).

Further, in the embodiment of FIG. 7, as for the information signals applied to signal electrodes in the odd frame $F_{2M-1}$, a white signal ("W", providing a voltage $3V_0$ exceeding the threshold voltage of the ferroelectric liquid crystal at the second phase in combination with the scanning selection signal $S_{2n-1}$ to form a white pixel) and a hold signal ("H", providing a pixel with voltages $\pm V_0$ below the threshold voltage of the ferroelectric liquid crystal in combination with the scanning selection signal $S_{2n-1}$) are selectively applied in phase with the scanning signal $S_{2n-1}$; and a black signal ("B", providing a voltage $-3V_0$ exceeding the threshold voltage of the ferroelectric liquid crystal at the second phase in combination with the scanning selection signal $S_{2n}$ to form a black pixel) and a hold signal ("H", providing a pixel with voltages $\pm V_0$ below the threshold voltage of the ferroelectric liquid crystal) are selectively applied in phase with the scanning selection signal $S_{2n}$.

In the even frame $F_{2M}$ subsequent to writing in the above-mentioned odd frame $F_{2M-1}$, the above-mentioned black signal ("B") and hold signal ("M") are selectively applied in phase with the scanning selection signal $S_{2n-1}$, and the above mentioned white signal ("W") and hold signal ("H") are selectively applied in phase with the scanning selection signal $S_{2n}$.

Figure 8:
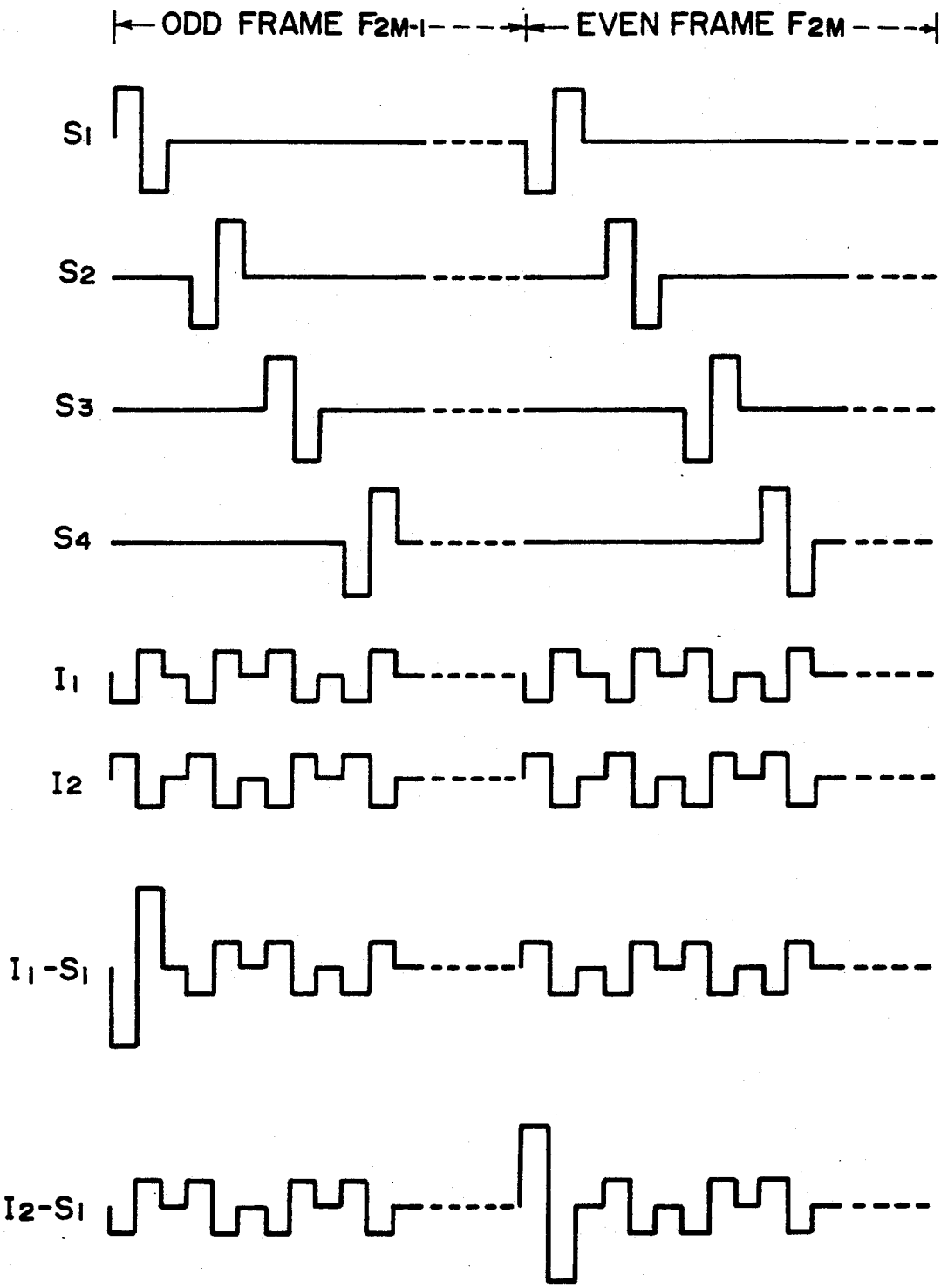
FIG. 8 is a time-serial waveform diagram using the same.
Figure 13:
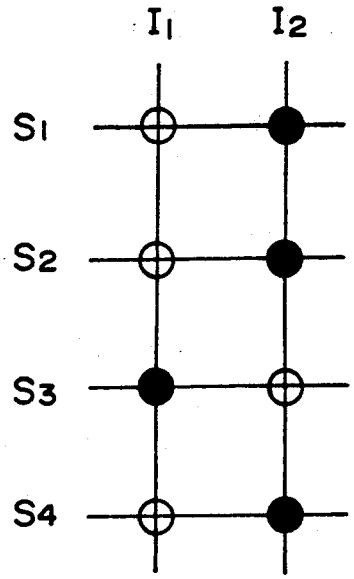
FIG. 13 is a plan view showing a display example.

FIG. 8 is a time chart for providing a display state shown in FIG. 13 (wherein ○ denotes a white pixel and denotes a black pixel) by using the unit signals shown in FIG. 8. In FIG. 8, at $I_1-S_1$ is shown a time-sectional voltage waveform applied to the intersection of a scanning electrode $S_1$ and a signal electrode or data electrode $I_1$, and at $I_2-S_1$ is shown a time-serial voltage waveform applied to the intersection of the scanning electrode $S_1$ and a signal electrode $I_2$.

Figure 10:
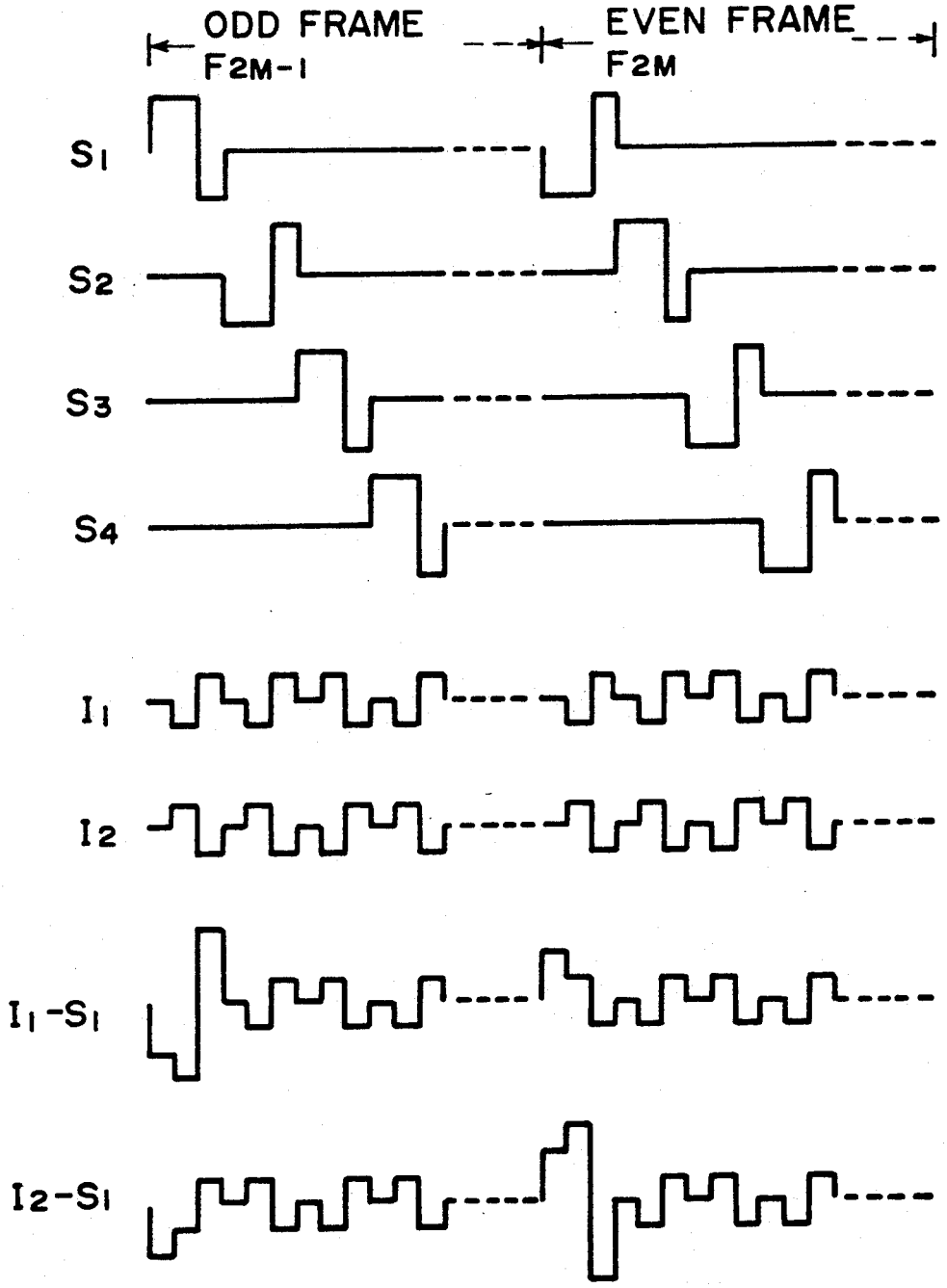
FIG. 10 is a time-serial waveform diagram using the same.

FIG. 9 shows another set of driving signal waveforms used in the invention. Scanning selection signals $S_{2n-1}$ and $S_{2n}$ used in the embodiment of FIG. 9 respectively have two voltage pulses of mutually opposite polarities with respect the voltage level of the scanning nonselection signal, and the former voltage pulses have durations twice those of the latter pulses of the opposite polarities. Further, each of the information signals has a zero voltage (the same voltage level as the scanning nonselection signal) at the first phase and has an alternating voltage with voltages of mutually opposite polarities with respect to the voltage level of the scanning nonselection signal at the second and third phases. FIG. 10 is a time chart for providing a display state shown in FIG. 13 by using the unit signals shown in FIG. 9.

FIGS. 11 and 12 respectively show another set of the driving signal waveforms used in the invention. In the embodiments shown in FIGS. 11 and 12, each of the scanning selections and information or data signals is set to have two levels, so that the designing of the drive circuit is simplified.

In the above driving embodiments, the amplitude of the scanning selection signals is set to $2|\pm V_0|$, and the amplitude of the information signals is set to $|IV_0|$. In the present invention, the amplitude of the scanning selection signal may be set to $|S_{ap}|$ and the amplitude of the information signals may be set to $|I_{ap}|$ so as to satisfy the relationship of $|I_{ap}|/|S_{ap}| \leqq 1$, preferably $|I_{ap}|/|S_{ap}| < 1/1.2$.

Further, in the present invention, when a ferroelectric liquid crystal shows two threshold voltages, $Vth_1$ and $-Vth_2$ ($Vth_1$, $Vth_2 > 0$), the above-mentioned voltage $V_0$ may be set to satisfy:

$$V_0 < Vth_1 < 3V_0 \text{ and } -3V_0 < -Vth_2 < -V_0.$$

The following Table 1 shows a time table for applying a white selection voltage Sw and a half-selection voltage H at that time for forming white selection pixels in frames $F_1$, $F_2$, $F_3$, $F_4$, . . .

TABLE 1

| | $F_1$ | $F_2$ | $F_3$ | $F_4$ . . . |
|---|---|---|---|---|
| Scanning line $S_1$ | Sw | H | Sw | H |
| Scanning line $S_2$ | H | Sw | H | Sw |
| Scanning line $S_3$ | Sw | H | Sw | H |
| Scanning line $S_4$ | H | Sw | H | Sw |
| . | | | | |
| . | | | | |
| . | | | | |

In contrast, the following Table 2 shows a similar time table for writing white selection pixels outside this aspect of the present invention.

TABLE 2

| | $F_1$ | $F_2$ | $F_3$ | $F_4$ . . . |
|---|---|---|---|---|
| Scanning line $S_1$ | Sw | H | Sw | H |
| Scanning line $S_2$ | Sw | H | Sw | H |
| Scanning line $S_3$ | Sw | H | Sw | H |
| Scanning line $S_4$ | Sw | H | Sw | H |
| . | | | | |
| . | | | | |
| . | | | | |

According to the time table 1 of the present invention, a half-selection voltage is applied to pixels (white selection pixels) on the odd-numbered scanning lines $S_1$, $S_3$, . . . in the even-numbered frames $F_2$, $F_4$, . . . In contrast, according to the time table 2 outside the present invention, such a half-selection voltage is applied to pixels (white selection pixels) on all the scanning lines in the even-numbered frames $F_2$, $F_4$, . . . Accordingly, in the driving embodiment outside the present invention shown in Table 2, flickering occurs at a half of the frame frequency. In contrast thereto, according to time table 1 of the present invention, the number of pixels supplied with a half selection voltage during one frame period is decreased to a half of that according to the time table 2, so that flickering is effectively prevented or alleviated. FIGS. 14 and 15 respectively show another set of driving signal waveforms used in the invention. More specifically, in the driving embodiment shown in FIG. 14, the scanning selection signal applied to 1st, 2nd, 5th, 6th, . . . (4N−3)th and 4(N−2)th scanning electrodes (N=1, 2, 3, . . . ), and the scanning selection signal applied to 3rd, 4th, 7th, 8th, . . . (4N−1)th and 4N-th scanning electrodes, are respectively changed depending on whether they are applied in an odd frame or an even frame. Further, in the embodiment shown in FIG. 15, the scanning selection signal applied to 1st, 2nd, 3rd, . . . (6N−5)th, (6N−4)th and (6N−3)th scanning electrodes (N=1, 2, . . . ), and the scanning selection signal applied to 4th, 5th, 6th, . . . (6N−2)th, (6N−1)th and 6N-th scanning electrodes, are respectively changed depending on whether they are applied in an odd frame or in an even frame. The above-mentioned number "N" refers to the number of blocks when the scalling lines are divided into the blocks in a plurality. In the embodiments of FIGS. 14 and 15, the number of scanning lines in each block has been 2 and 3, respectively, but is not generally restricted to these numbers.

As a preferred embodiment of the present invention, there is provided a driving apparatus, comprising scanning electrodes, scanning-side drive means connected to the scanning electrodes, data electrodes intersecting with the scanning electrodes and data-side drive means connected to the data electrodes; the improvement wherein said scanning-side drive means includes means for supplying a first scanning selection signal having a voltage of one polarity and a second scanning selection signal having a voltage of the other polarity at the same phase, respectively with respect to the level of a voltage applied to a scanning nonselection electrode, said first and second scanning selection signals being supplied in one vertical scanning period and supplied to one scanning electrode in at least two vertical, scanning periods; and said data-side drive means includes means for supplying an alternating voltage.

FIGS. 16 shows an embodiment of driving signal waveforms used in such a driving apparatus. More specifically, FIG. 16 shows a scanning selection signal $S_{2n-1}$ (n=1, 2, 3 . . . ) applied to an odd-numbered scanning electrode and a scanning selection signal $S_{2n}$ applied to an even-numbered scanning electrode in both an odd-numbered frame $F_{2M-1}$ and an even-numbered frame $F_{2M}$. According to FIG. 16, the scanning selection signal $S_{2n-1}$ has mutually opposite voltage polarities (i.e., voltage polarities with respect to the voltage of the scanning nonselection signal) in the odd frame $F_{2M-1}$ and the even frame $F_{2M}$. This also holds true with the scanning selection signal. Further, the scanning selection signals $S_{2n-1}$ and $S_{2n}$ applied in one frame period have mutually different voltage waveforms and have mutually opposite voltage polarities in a single phase.

Further, in the driving embodiment shown in FIG. 16, a first phase for providing the whole picture with a pose (e.g., by applying a zero voltage to all the pixels constituting the picture) is provided and the first and third phases for each scanning selection signal are set to a zero voltage (the same voltage level as the scanning nonselection signal).

Further, in the embodiment of FIG. 16, as for the information signals applied to signal electrodes in the odd frame $F_{2M-1}$, a white signal ("W" providing a voltage $3V_0$ exceeding the threshold voltage of the ferroelectric liquid crystal at the second phase in combination with the scanning selection signal $S_{2n-1}$ to form a white pixel) and a hold signal ("H", providing a pixel with voltages $\pm V_0$ below the threshold voltage of the ferroelectric liquid crystal in combination with the scanning selection signal $S_{2n-1}$) are selectively applied in phase with the scanning selection signal $S_{2n-1}$; and a black signal ("B", providing a voltage $-3V_0$ exceeding the threshold voltage of the ferroelectric liquid crystal at the second phase in combination with the scanning selection signal $S_{2n}$ to form a black pixel) and a hold signal ("H", providing a pixel with voltages $\pm V_0$ below the threshold voltage of the ferroelectric liquid crystal) are selectively applied in phase with the scanning selection signal $S_{2n}$.

In the even frame $F_{2M}$ subsequent to writing in the above-mentioned odd frame $F_{2M-1}$, the above-mentioned black signal ("B") and hold signal ("H") are selectively applied in phase with the scanning selection signal $S_{2n-1}$, and the above mentioned white signal ("W") and hold signal ("H") are selectively applied in phase with the scanning selection signal $S_{2n}$.

Figure 17:
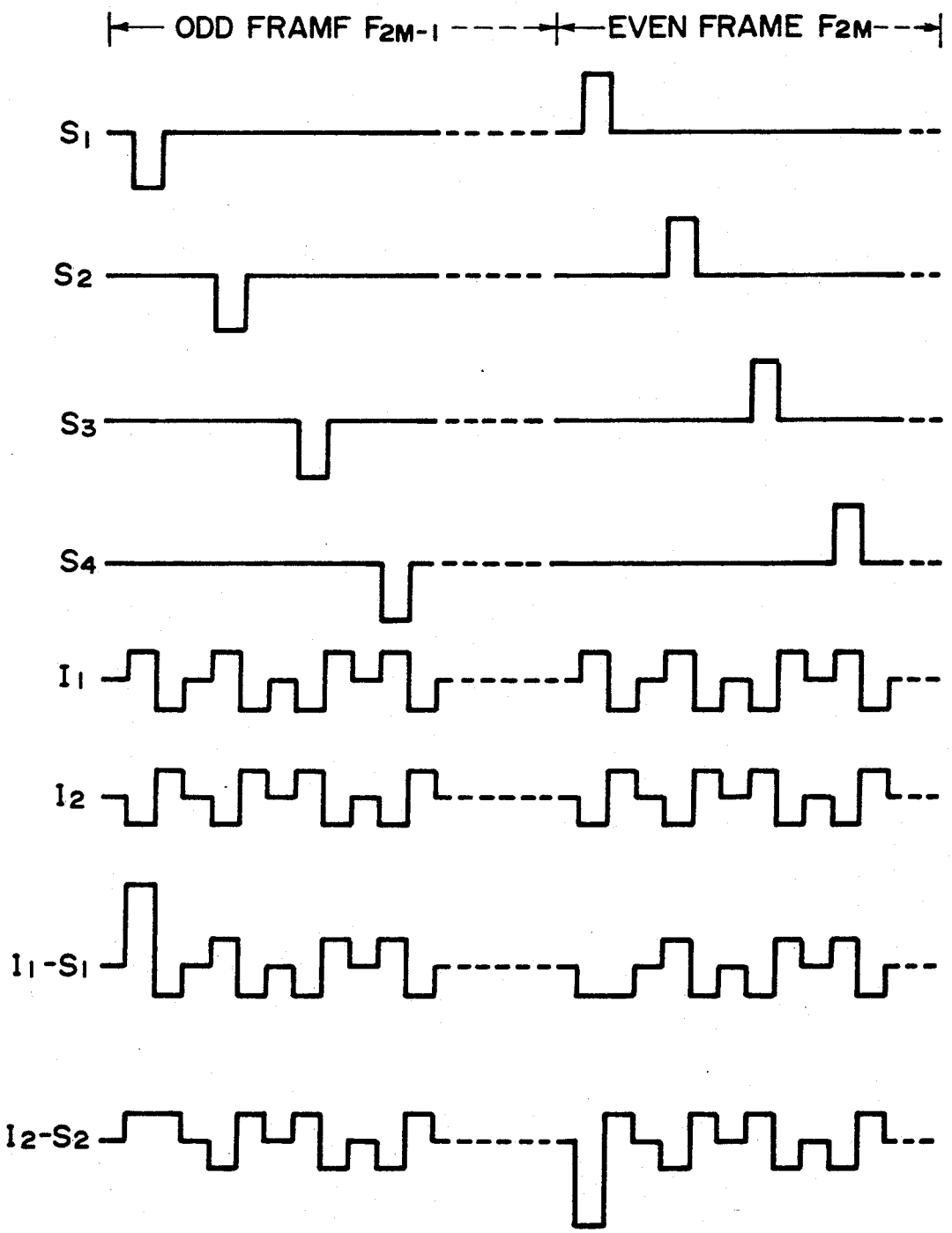
FIG. 17 is a time-serial waveform diagram using the same.

FIG. 17 is a time chart for providing a display state shown in FIG. 13 by using the unit signals shown in FIG. 16. In FIG. 17, at $I_1-S_1$ is shown a time-serial voltage waveform applied to the intersection of a scanning electrode $S_1$ and a signal electrode or data electrode $I_1$, and at $I_2-S_1$ is shown a time-serial voltage waveform applied to the intersection of the scanning electrode $S_1$ and a signal electrode $I_2$.

FIG. 18 shows another set of driving signal waveforms used in the invention. Scanning selections $S_{2n-1}$ and $S_{2n}$ used in the embodiment of FIG. 18 assume waveforms obtained by removing the first phase of voltage zero from those shown in FIG. 16, thus providing a shorter scanning period than FIG. 16. Likewise the scanning selection signals, the information or data signals assume waveforms obtained by the first phase of voltage zero from those shown in FIG. 16. As a result, each of the information signals shown in FIG. 18 comprises an alternating voltage with voltages of mutually opposite polarities with respect to the voltage level of the scanning nonselection signal at the first and second phases.

FIG. 19 shows another preferred set of driving waveforms. In the embodiment of FIG. 19, a white signal or a black signal and the corresponding hold signal among the information signals have such a voltage waveform relationship that one is obtained by phase-shifting the other, so that flickering can be further alleviated.

Also in these embodiments, when a ferroelectric liquid crystal shows two threshold voltages, $Vth_1$ and $-Vth_2$ ($Vth_1$, $Vth_2>0$), the above-mentioned voltage $V_0$ may be set to satisfy: $V_0<Vth_1<3V_0$ and $-3V_0<-Vth_2<-V_0$.

FIGS. 20 and 21 respectively show another set of driving signal waveforms used in the invention. More specifically, in the driving embodiment shown in FIG. 20, the scanning selection signal applied to 1st, 2nd, 5th, 6th, . . . (4N−3)th and 4(N−2)th scanning electrodes (N=1, 2, 3 . . . ) and the scanning selection signal applied to 3rd, 4th, 7th, 8th, . . . (4N−1)th and 4N-th scanning electrodes, are respectively changed depending on whether they are applied in an odd frame or an even frame. Further, in the embodiment shown in FIG. 21, the scanning selection signal applied to 1st, 2nd, 3rd, . . . (6N−5)th, (6N−4)th and (6N−3)th scanning electrodes (N=1, 2, . . . ), and the scanning selection signal applied to 4th, 5th, 6th, . . . (6N−2)th, (6N−1)th and 6N-th scanning electrodes, are respectively changed depending on whether they are applied in an odd frame or in an even frame. The above-mentioned number "N" refers to the number of blocks when the scanning lines are divided into the blocks in a plurality. In the embodiments of FIGS. 20 and 21, the number of scanning lines in each block has been 2 and 3, respectively, but is not particularly limited in general.

In this embodiment of the invention, when the duration of a voltage pulse of one polarity or the other polarity is defined as $\Delta T$, a voltage at the same level as the scanning nonselection signal (i.e., a zero voltage) in the scanning selection signals may be set to have a duration of $2\Delta T$ or longer.

Figures 24A, 24B:
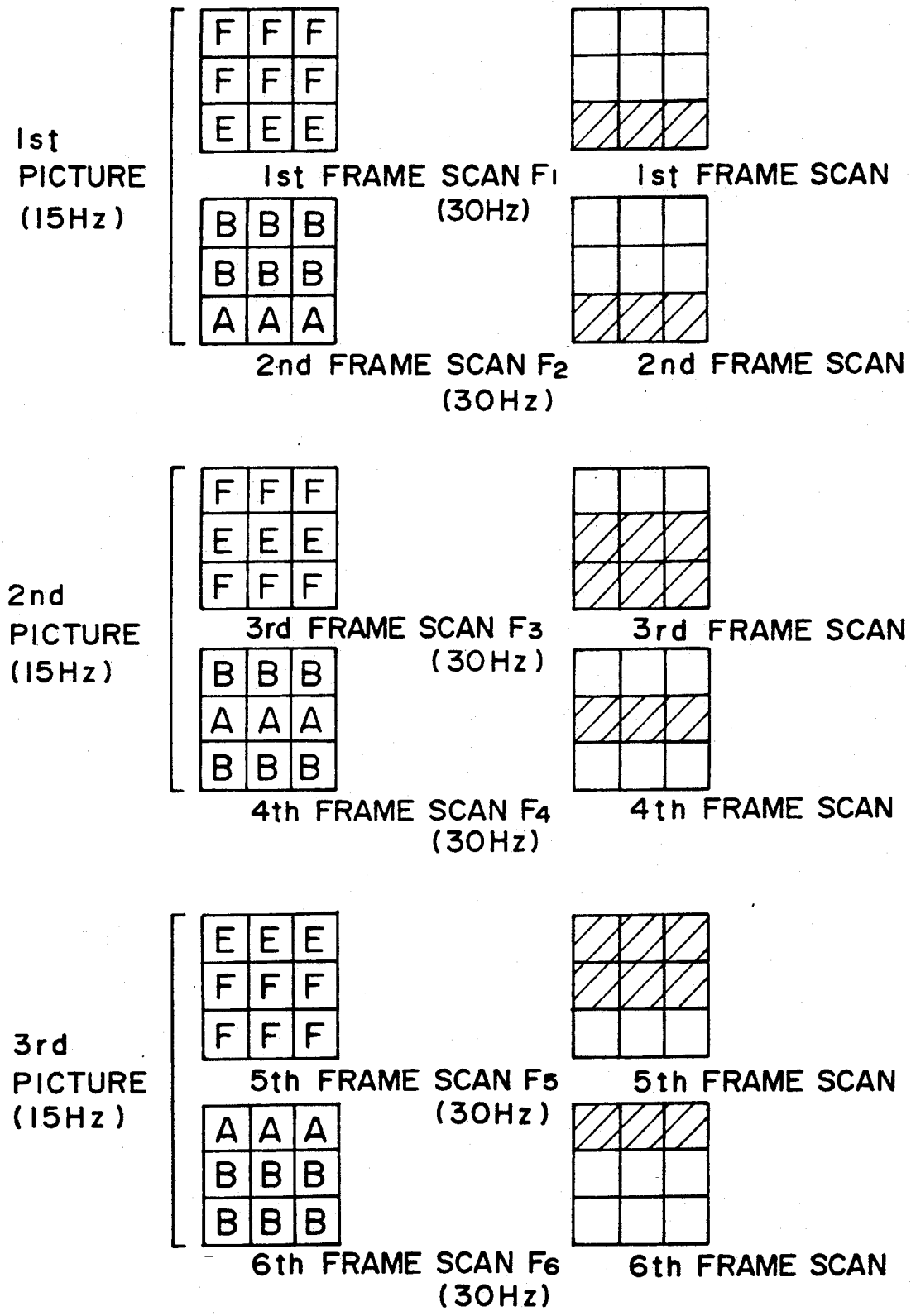
FIG. 24A is an explanatory view illustrating voltage application states at pixels on a picture outside the scope of the present invention.
FIG. 24B is an explanatory view showing the corresponding display states.

FIGS. 24A and 24B are presented for illustrating a problem encountered in smooth scrolling.

Figure 23:
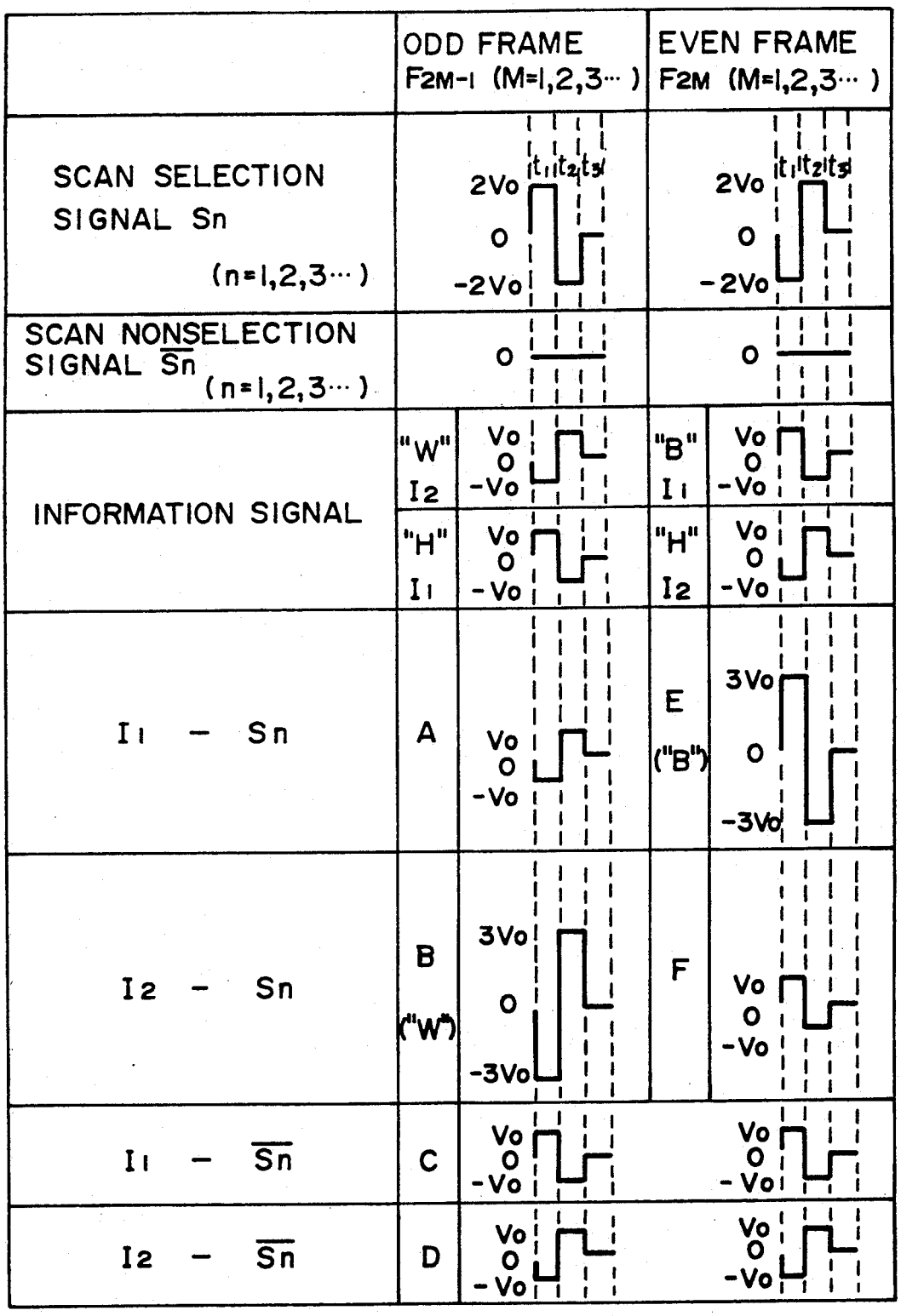
FIG. 23 is a waveform diagram showing still another set of driving waveforms used in the invention.

FIG. 24A illustrates voltage application states for subjecting a picture of 9(=3×3) letters each formed of 4×4 pixels (not shown) as a block on a display screen "A", "B", "E" and "F" denote voltage waveforms applied to one letter and shown in FIG. 23 with labels of "A", "B", "E" and "F", respectively. FIG. 24B illustrates corresponding display states of one picture when subjected to smooth scrolling at a frame frequency of 30 Hz and a one picture-forming frequency of 15 Hz, wherein a hatched portion represents a black display state and a blank portion represents a white display state. It should be noted that an embodiment of scrolling solid black patterns, instead of actual letters, in the white back ground is illustrated in FIGS. 24A and 24B for the simplicity of understanding.

According to FIG. 24, at the time of 3rd frame scan, an unnecessary black display state appears on the third letter row of the picture and at the time of 5th frame scan, an unvessary black display state appears on the second letter row. It has been found that these unnecessary black display states cause "tailing" on a display at the time of scrolling. The unnecessary black display states appearing at the time of 3rd and 5th frame scan occur because the black display states formed at the time of 2nd and 4th frame scaare memorized as they are at the time of the 3rd and 5th scan.

According to our experiments, the "tailing" is visually recognized as such to a viewer because the display periods for the 3rd and 5th frame scan are equally long as those for the 4th and 6th frame scan so that the display states at the time of the 3rd and 5th frame scan can be sufficiently recognized by the viewer.

Figure 22A:
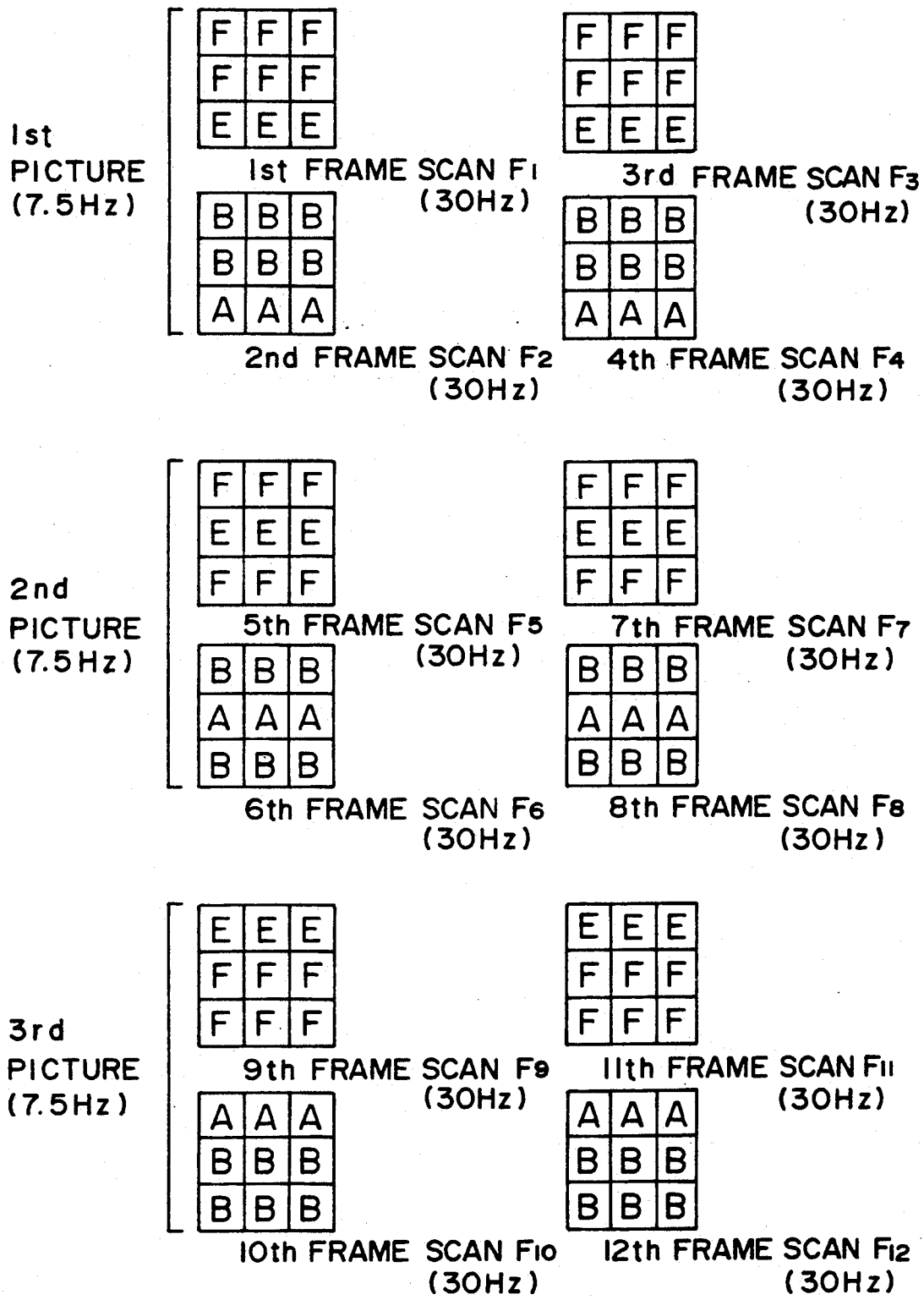
FIG. 22A is an explanatory view illustrating voltage application states at pixels (on scanning selection lines) on a picture according to the invention.
Figure 22B:
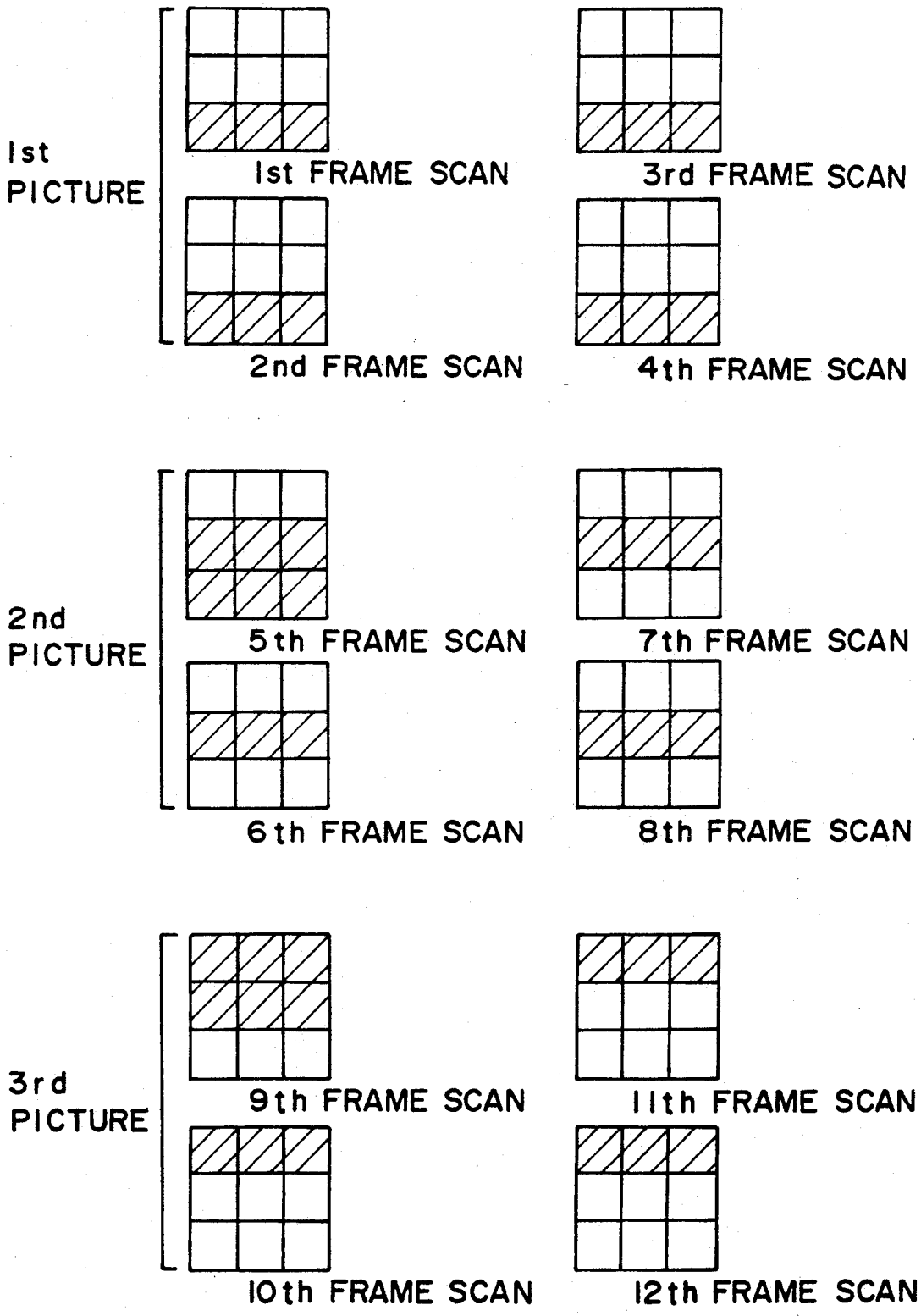
FIG. 22B is an explanatory view illustrating the corresponding display states.

FIGS. 22A and 22B are explanatory views, corresponding to FIGS. 24A and 24B, for illustrating the embodiment of the present invention. More specifically, similarly as FIG. 24A, FIG. 22A illustrates voltage application states for subjecting a picture of 3×3 letters each formed of 4×4 pixels as a block on a display screen to smooth scrolling. In the figure, "A", "B", "E" and "F" have the same meanings as in FIGS. 24A. Further, "A" and "F" are voltages applied at the time of half-selection, and "B" and "E" are voltages applied at the time of selection for writing white ("W") and black ("B"), respectively. FIG. 22B illustrates display states of a picture, corresponding to voltage application states shown in FIG. 22A, when subjected to smooth scrolling at a frame frequency of 30 Hz, a one picture-forming frequency of 7.5 Hz and a voltage $3V_0=42$ volts. In the figure, a hatched portion represents a black display state and a blank portion represents a white display state.

According to the embodiment shown in FIG. 22, in an odd frame $F_{2M-1}$ (M=1, 2, 3, . . . ), a frame scan is effected by using the scanning selection signal for an odd frame in FIG. 23, and in an even frame $F_{2M}$ (M=1, 2, 3, . . . ), frame scan is effected by using the scanning selection signal for an even frame in FIG. 23. These frame scans are repeated alternately two times each to form one picture. By adopting this driving method, as shown in FIG. 22B, the display period of black display states appearing on the third row at the time of 5th frame scan and on the second row at the time of 9th frame scan is decreased to ¼ of the total time of one picture display. According to our experiments, smooth scrolling was effected without causing visually recognizable "tailing" to a view as a result.

As briefly explained hereinabove, FIG. 23 shows a set of driving signal waveforms used in the embodiment of FIG. 22, scanning selection signals Sn (n: number of scanning lines) applied in an odd frame $F_{2M-1}$ and an even frame $F_{2M}$ have voltages of mutually opposite polarities (with respect to the voltage level of scanning nonselection signal) at each of the phases $t_1$ and $t_2$. The phase $t_2$ is for writing, and the phases $t_1$ and $t_3$ are for applying an auxiliary signal to data lines. By applying the auxiliary signal, before the period of a voltage of one and the same polarity being applied to a pixel on a scanning line reaches a critical period beyond which one stable state of the ferroelectric liquid crystal is inverted to the other stable state, a voltage of opposite polarity to the above-mentioned voltage of one and the same polarity or a zero voltage is applied to the pixel as a result of the combination of the auxiliary signal and a voltage applied to a scanning nonselection line. In this instance, the voltage $V_0$ is set to satisfy the relationship of $|\pm V_0| < |Vth| < |\pm 3V_0|$ with the threshold voltage of the ferroelectric liquid crystal. In the above, an embodiment using a frame frequency of 30 Hz is explained, but the present invention is not restricted to the operation but may be operated with a lower or higher frequency.

Figure 25:
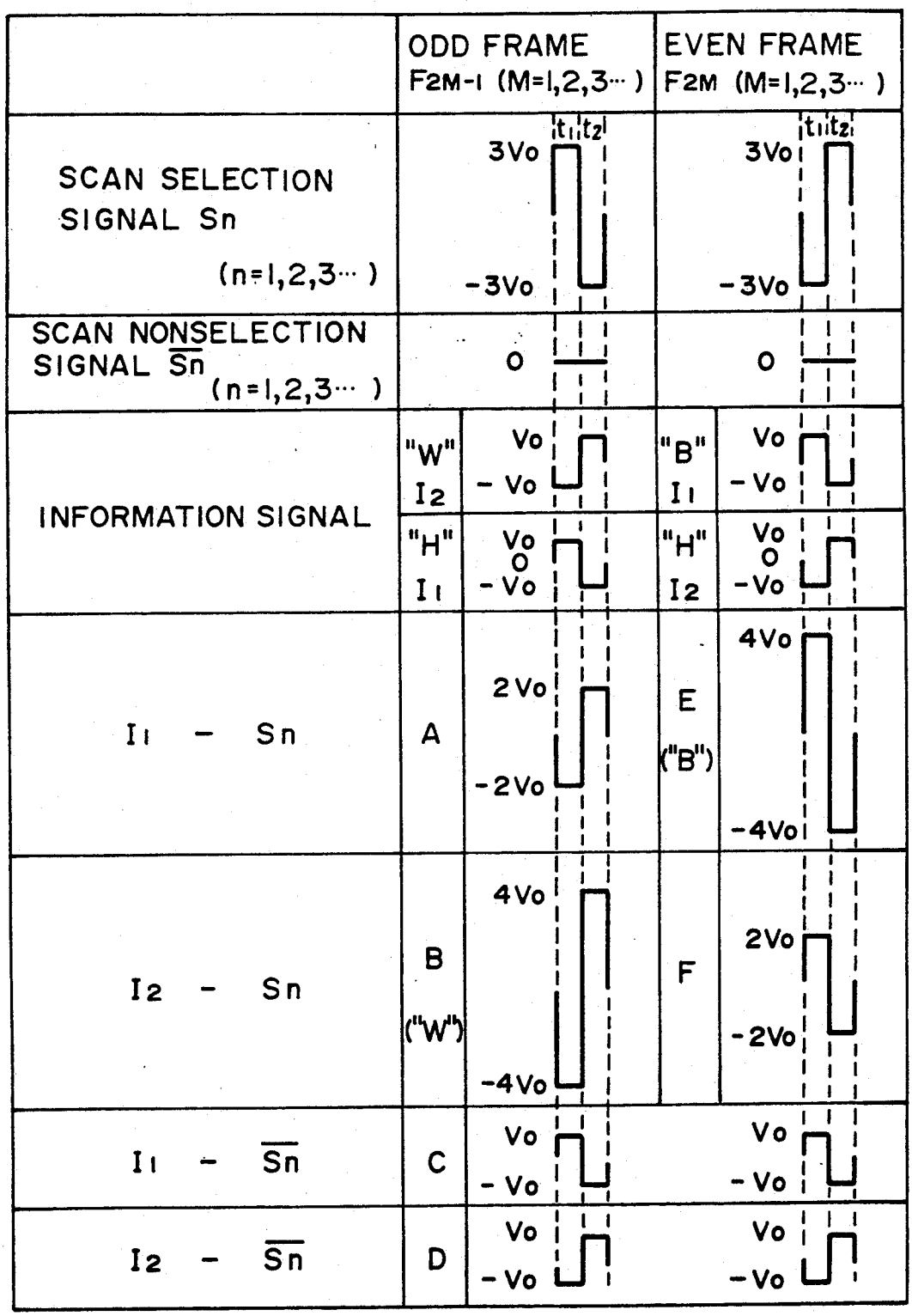
FIGS. 25 and 26 are waveform diagrams each showing still another set of driving waveforms used in the invention.

FIG. 25 shows another set of driving signal waveforms. In the driving embodiment shown in FIG. 25, in an odd frame period, selected pixels on a scanning line are written in white at phase $t_2$ of a scanning selection signal, and in an even frame period, the remaining pixels on the scanning line are written in black at phase $t_2$ of another scanning selection signal to form one picture. If the driving embodiment of FIG. 25 is applied to the smooth scrolling display method explained with reference to FIGS. 22A and 22B, similar effects as described above are attained. The phase $t_1$ of the scanning selection signal shown in FIG. 25 is a phase for applying an auxiliary signal to data lines, and similar results as explained above are obtained by the application of the auxiliary signal. In this instance, the voltage $V_0$ is set to satisfy the following relationship with the threshold voltage of the ferroelectric liquid crystal: $|\pm 2V_0 < |Vth| < |\pm 4V_0|$.

Figure 26:
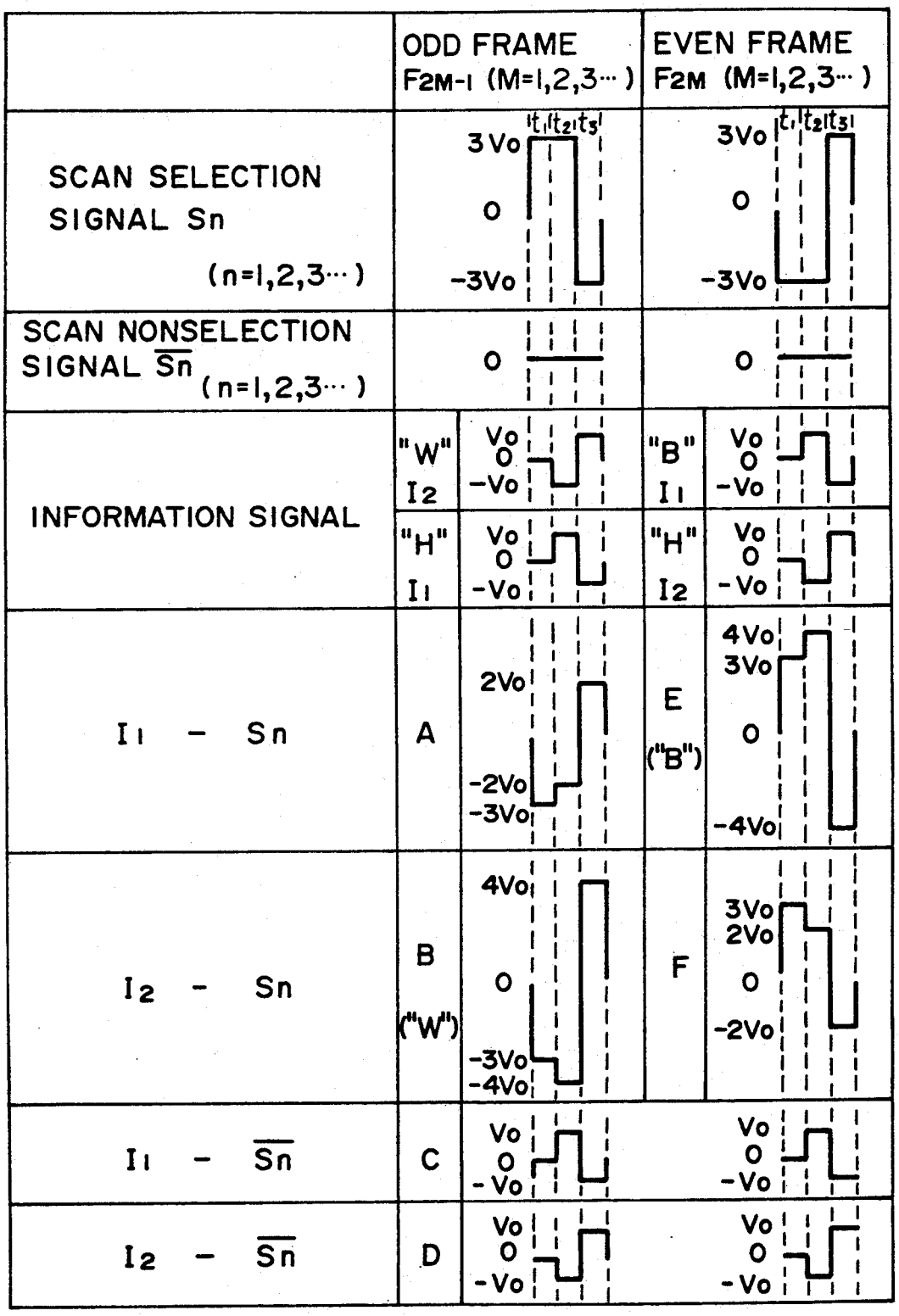

FIG. 26 shows still another set of driving signal waveforms. In the driving embodiment shown in FIG. 26, in an odd frame period, selected pixels on a scanning line are written in white at phase $t_3$ of a scanning selection signal, and in an even frame period, the remaining pixels on the scanning line are written in black at phase $t_3$ of another scanning selection signal to form one picture. If the driving embodiment of FIG. 26 is applied to the smooth scrolling display method explained with reference to FIG. 22, similar effects as described above are attained. The phases $t_1$ and $t_2$ of the scanning selection signal shown in FIG. 26 are phases for applying an auxiliary signal to data lines, and similar results as explained above are obtained by the application of the auxiliary signal. In voltage waveforms shown at A and F, voltages applied at phases $t_1$, $t_2$ and $t_3$ are set to below the threshold voltage of the ferroelectric liquid crystal.

Figure 27A:
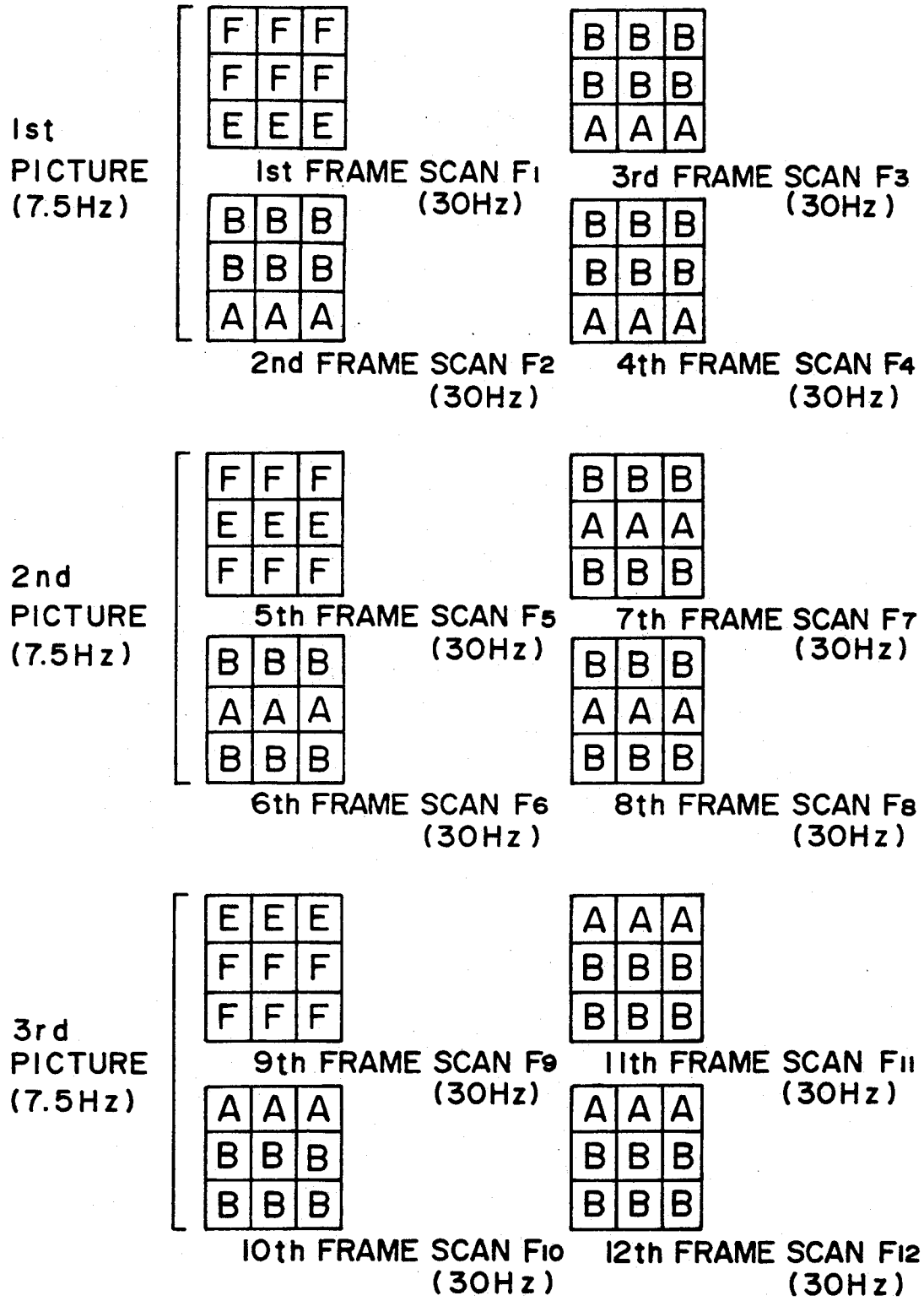
FIG. 27A is an explanatory view illustrating another set of voltage application states at pixels on a picture according to the invention.
Figure 27B:
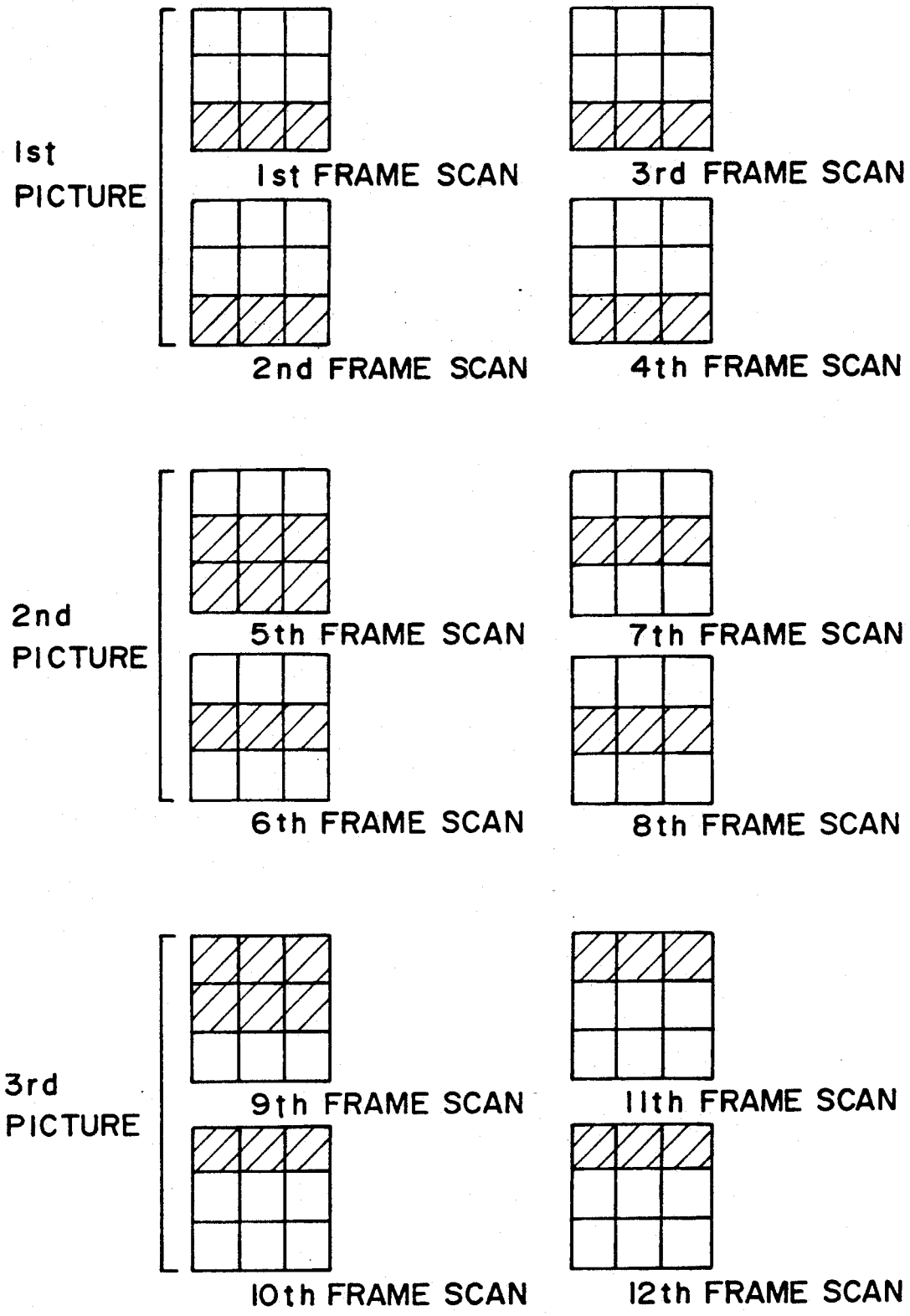
FIG. 27B is an explanatory view showing the corresponding display states.

FIGS. 27A and 27B show an embodiment to which another voltage application system is applied. In FIG. 27A, "A", "B", "E" and "F" have the same meanings as in FIG. 22A. In the embodiment shown in FIGS. 27A and 27B, three consecutive frame scans are effected by a single scanning selection signal.

In this aspect of the present invention, one scanning selection signal is used for a plurality of frame scans to alleviate the "tailing" phenomenon observed at the time of smooth scrolling. The number of frame scans effected by using one scanning selection signal can be increased to 20 at the maximum, but may preferably be 3 at the maximum.

As the ferroelectric liquid crystal having bistability used in the present invention, chiral smectic liquid crystals having ferroelectricity are most preferred. Among those liquid crystals, a liquid crystal in chiral smectic C phase (SmC*) or H phase is particularly suited. These ferroelectric liquid crystals are described in, e.g., "LE JOURNAL DE PHYSIQUE LETTERS" 36 (L-69), 1975 "Ferroelectric Liquid Crystals": "Applied Physics Letters" 36 (11) 1980, "Submicro Second Bistable Electrooptic Switching in Liquid Crystals", "Kotai Butsuri (Solid State Physics)" 16 (141), 1981 "Liquid Crystal", U.S. Pat. Nos. 4,561,726, 4,589,996, 4,592,858, 4,596,667, 4,613,209, 4,639,089, etc. Ferroelectric liquid crystals disclosed in these publications may be used in the present invention.

More particularly, examples of ferroelectric liquid crystal compound used in the present invention are decyloxybenzylidene-p'-amino-2-methylbutylcinnamate (DOBAMBC), hexyloxy-benzylidene-p'-amino-2-chloropropylcinnamate (HOBACPC), 4-O-(2-methyl)-butylresorcilidene-4'-octylaniline (MBRA 8), etc.

When a device is constituted using these materials, the device may be supported with a block of copper, etc. in which a heater is embedded in order to realize a temperature condition where the liquid crystal compounds assume an SmC*− or SmH*− phase.

Further, in the present invention, it is possible to use a ferroelectric liquid crystal in chiral smectic F phase, I phase, G phase or K phase in addition to the above mentioned SmC* and SmH* phases.

Figure 28:
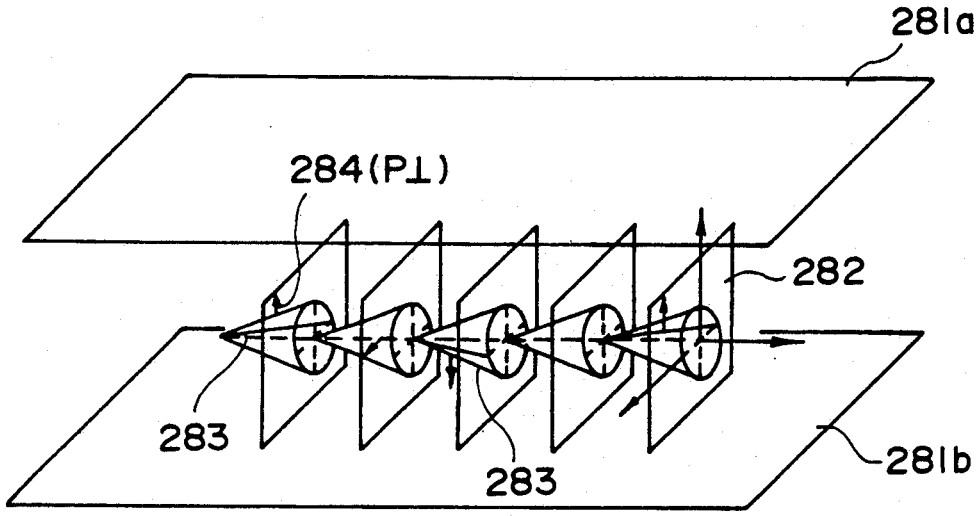
FIGS. 28 and 29 are schematic perspective views illustrating a ferroelectric liquid crystal device used in the invention.
Figure 29:
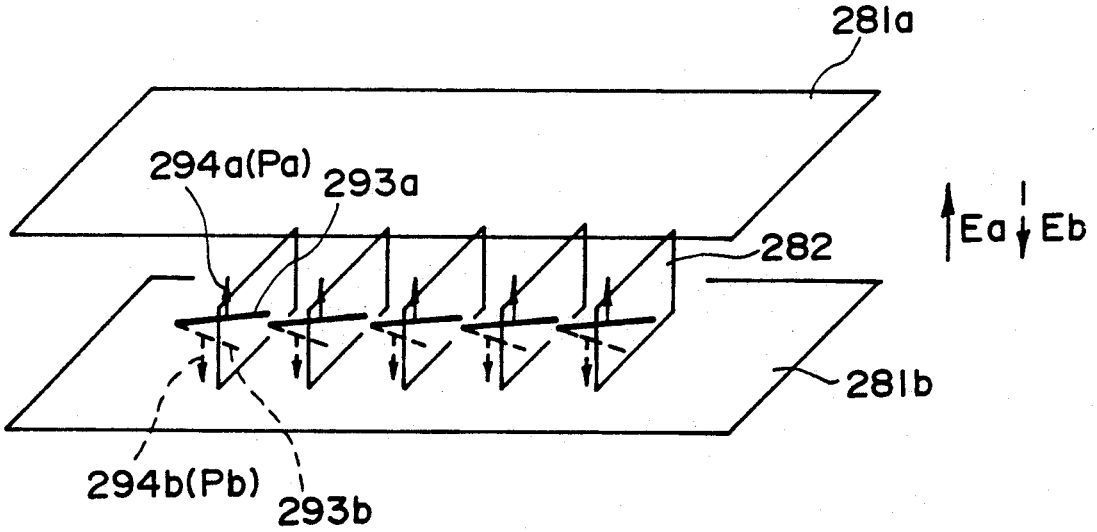

Referring to FIG. 28, there is schematically shown an example of a ferroelectric liquid crystal cell. Reference numerals 281*a* and 281*b* denote base plates (glass plates) on which a transparent electrode of, e.g., $In2O_3$, $SnO_2$, ITO (Indium-Tin-Oxide), etc., is disposed, respectively. A liquid crystal of an SmC*-phase in which liquid crystal molecular layers 282 are oriented perpendicular to surfaces of the glass plates is hermetically disposed therebetween. A full line 283 shows liquid crystal molecules. Each liquid crystal molecule 283 has a dipole moment (P⊥) 284 in a direction perpendicular to the axis thereof. When a voltage higher than a certain threshold level is applied between electrodes formed on the base plates 281*a* and 281*b*, a helical or spiral structure of the liquid crystal molecule 283 is loosened or released to change the alignment direction of respective liquid crystal molecules 283 so that the dipole moment (P⊥) 284 are all directed in the direction of the electric field. The liquid crystal molecules 283 have an elongated shape and show refractive anisotropy between the long axis and the short axis thereof. Accordingly, it is easily understood that when, for instance, polarizers arranged in a cross nicol relationship, i.e., with their polarizing directions crossing each other, are disposed on the upper and the lower surfaces of the glass plates, the liquid crystal cell thus arranged functions as a liquid crystal optical modulation device of which optical characteristics vary depending upon the polarity of an applied voltage. Further, when the thickness of the liquid crystal cell is sufficiently thin (e.g., 1μ), the helical structure of the liquid crystal molecules is loosened without application of an electric field whereby the dipole moment assumes either of the two states, i.e., Pa in an upper direction 294a or Pb in a lower direction 294b, thus providing a bistability condition, as shown in FIG. 29. When an electric field Ea or Eb higher than a certain threshold level and different from each other in polarity as shown in FIG. 29 is applied to a cell having the above-mentioned characteristics, the dipole moment is directed either in the upper direction 294a or in the lower direction 294b depending on the vector of the electric field Ea or Eb. In correspondence with this, the liquid crystal molecules are oriented to either a first orientation state 293a or a second orientation state 293b.

When the above-mentioned ferroelectric liquid crystal is used as an optical modulation element, it is possible to obtain two advantages. First is that the response speed is quite fast. Second is that the orientation of the liquid crystal shows bistability. The second advantage will be further explained, e.g., with reference to FIG. 29. When the electric field Ea is applied to the liquid crystal molecules, they are oriented in the first stable state 293a. This state is stably retained even if the electric field is removed. On the other hand, when the electric field Eb of which direction is opposite to that of the electric field Ea is applied thereto, the liquid crystal molecules are oriented to the second orientation state 293b, whereby the directions of molecules are changed. Likewise, the latter state is stably retained even if the electric field is removed. Further, as long as the magnitude of the electric field Ea or Eb being applied is not above a certain threshold value, the liquid crystal molecules are placed in the respective orientation states. In order to effectively realize high response speed and bistability, it is preferable that the thickness of the cell is as thin as possible and generally 0.5 to 20μ, particularly 1 to 5μ.

Figure 30:
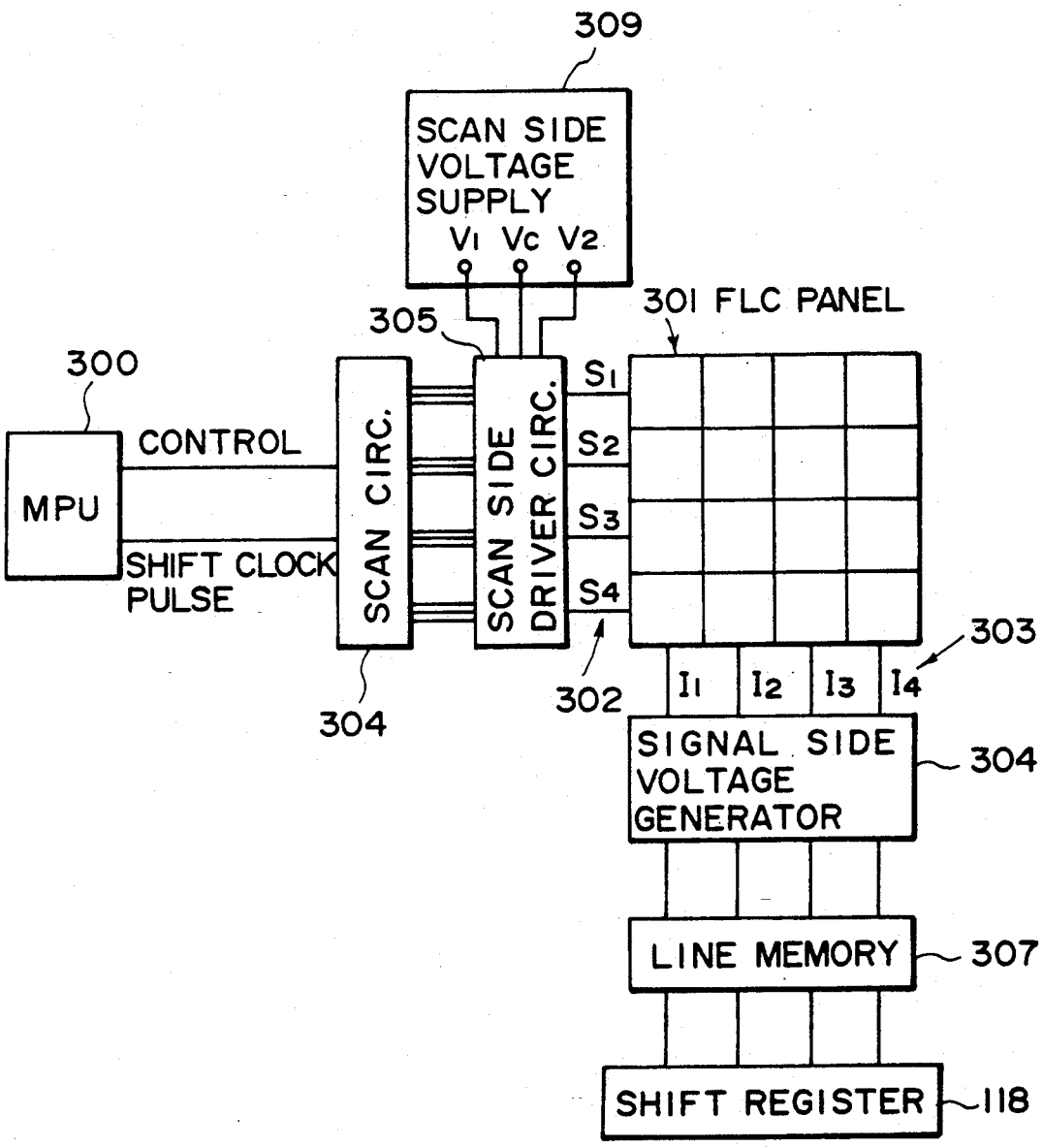
FIG. 30 is a block diagram of a display panel according to the invention.

FIG. 30 shows a driving apparatus for a ferroelectric liquid crystal panel 301 with a matrix electrode arrangement used in the present invention. Referring to FIG. 30, the panel 301 is provided with scanning lines 302 and data lines 303 intersecting with each other. A ferroelectric liquid crystal is disposed between the scanning lines 302 and the data lines 303 so as to form a pixel at each intersection of the scanning lines 302 and the data lines 303. The ferroelectric liquid crystal panel 301 is connected through the scanning lines 302 to a scanning driver circuit 305, a scanning circuit 304 and a microprocessor unit (MPU), and is connected through the data lines 303 to a signal-side voltage generator circuit 306, a line memory 307 and a shift register 308.

The scanning driver circuit is further connected to a scanning side driving voltage supply 309 which supplies three voltages $V_1$, $V_2$ and $V_c$ among which the voltages $V_1$ and $V_2$, for example, may be used for providing the above-mentioned scanning selection signals and the voltage $V_c$ is used for providing the scanning nonselection signal.

Hereinbelow, the present invention is explained with reference to a specific example.

EXAMPLE 1

A pair of square glass substrates each provided with 62.5 μm-wide ITO stripe electrodes formed at a pitch of 100 μm were provided and were respectively further coated with a 1000 Å-thick $SiO_2$ film as an insulating film and a 500 Å-thick polyvinyl alcohol film as an alignment control film.

Then, the polyvinyl alcohol film disposed on each substrate was subjected to surface rubbing treatment. Further, silica beads with an average particle size of 1.5 μm were dispersed on one of the substrates, and the periphery of the other substrate was coated with an epoxy adhesive as a sealing agent. Therefore, the two substrates were superposed with each other so that their ITO stripe electrodes crossed each other and their rubbing directions were in parallel with each other to form a blank cell, into which "CS-1014" (trade name, available from Chisso K.K.) heated to its isotropic phase was charged, followed by gradual cooling to develop ferroelectric SmC*.

The thus obtained ferroelectric liquid crystal cell was supplied with an alternating pulse with various amplitudes Vb and Vw and durations $t_1=t_2=30$ μsec shown in FIG. 1. The thus measured invention voltages (Vw) were platted versus various values of $|Vb/Vw|$ to provide the characteristic curve 11 shown in FIG. 1.

Then, multiplexing drive was effected by applying driving voltage waveforms shown in FIG. 2 to the above ferroelectric liquid crystal cell. In this instance, a normal static picture was formed when the voltage $|V_I-V_S|$ was set to 21 volts, $|V_I|/|V_S+V_I|$ was set to $\frac{1}{3}$, and each of phases $t_1$ and $t_2$ was set to 30 μsec.

On the other hand, when it was tried to form a static picture in the same manner as above except that the ratio $|V_1|/|V_S+V_I|$ was set to $\frac{2}{3}$, a normal display could not be effected.

EXAMPLE 2

A ferroelectric liquid crystal cell was prepared in the same manner as in Example 1 except that the "CS-1014" (trade name) was changed to another ferroelectric liquid crystal "CS-1011" (trade name, available from Chisso K.K.). The thus obtained ferroelectric liquid crystal cell was supplied with an alternating pulse with various amplitudes Vb and Vw as shown in FIG. 1. The inversion voltages (Vw) thus measured were plotted to provide the characteristic curve 12 shown in FIG. 1.

Then, multiplexing drive was effected by applying driving voltage waveforms shown in FIG. 6 to the above ferroelectric liquid crystal cell. By setting the voltage $|V_I+V_S|$ to 21 volts, the ratio $|V_I|/|V_S+V_I|$ to $\frac{1}{3}$, and each of the phases $t_1$, $t_2$ and $t_3$ to 30 μsec, a normal static picture was formed.

On the other hand, when it was tried to form a static picture in the same manner as above except that the ratio $|V_I|/|V_S+V_I|$ was set to $\frac{2}{3}$, a normal display could not be effected.

As described above, according to the present invention, the adverse effect of a reverse-polarity fore pulse on writing can be minimized, so that normal display can be effected with a larger driving margin.

Further, according to the present invention, flickering observed at the time of writing in a conventional driving method can be removed to provide an improved display quality.

Furthermore, according to the present invention, a "tailing" phenomenon observed on a picture at the time of motion picture display or smooth scrolling display can be alleviated to provide a motion picture display and a smooth scrolling display of a high image quality.

What is claimed is:

1. In a liquid crystal apparatus, comprising scanning electrodes and data electrodes intersecting each other to form a pixel at each intersection, a liquid crystal assuming a first optical state and a second optical state according to the polarity of a writing voltage applied thereto and disposed between the scanning electrodes and data electrodes, scanning-side drive means connected to the scanning electrodes, and data-side drive means connected to the data electrodes, the improvement wherein:

said scanning-side drive means includes means for supplying first and second scanning selection signals having mutually different voltage waveforms to the scanning electrodes, so that both the first and second scanning selection signals are applied to the scanning electrodes in one vertical scanning period, and a particular scanning electrode is supplied with both the first and second scanning selection signals in a first and a second vertical scanning period;

said data-side drive means including means for supplying data pulses to the data electrodes in synchronism with the first and second scanning selection signals;

said scanning-side drive means and data-side drive means, in combination, (i) in the first vertical scanning period, applying a first writing voltage to a first selected pixel on a first scanning electrode in response to receiving the first scanning selection signal so as to cause the first selected pixel to assume the first optical state, and applying a second writing voltage to a second selected pixel on a second scanning electrode in response to receiving the second scanning selection signal so as to cause the second selected pixel to assume the second optical state, and (ii) in the second vertical scanning period, applying a first non-writing voltage of an opposite polarity to the first writing voltage to the first selected pixel on the first scanning electrode in response to receiving the second scanning selection signal, and applying a second non-writing voltage of an opposite polarity to the second writing voltage to the second selected pixel on the second scanning electrode in response to receiving the first scanning selection signal.

2. A liquid crystal apparatus according to claim 1, wherein said scanning-side drive means and data-side drive means, in combination, further apply a fore voltage pulse prior to the application of the first and second writing voltages, the fore voltage pulse having a polarity opposite to that of the first or second writing voltages and having an amplitude which is no greater than one-half the amplitude of the first or second writing voltages.

3. A liquid crystal apparatus according to claim 2, wherein the fore voltage pulse has an amplitude which is $\frac{1}{3}$ or less of that of the writing voltage.

4. A liquid crystal apparatus according to claim 1, wherein the liquid crystal is a ferroelectric liquid crystal.

5. A liquid crystal apparatus according to claim 4, wherein said ferroelectric liquid crystal is a chiral smectic liquid crystal.

6. A liquid crystal apparatus according to claim 5, wherein said chiral smectic liquid crystal is disposed in a layer thin enough to release its helical structure in the absence of an electric field.

7. A liquid crystal apparatus according to claim 5, wherein said chiral smectic liquid crystal is in chiral smectic C phase or H phase.

8. A liquid crystal apparatus according to claim 1, wherein the first scanning electrode is an even-numbered one.

9. A liquid crystal apparatus according to claim 1, wherein the one vertical scanning period is a one-frame period.

10. A liquid crystal apparatus according to claim 1, wherein, on average, the voltage applied to the pixel is zero during a period of two successive vertical scanning periods.

11. A liquid crystal apparatus according to claim 1, wherein the first scanning selection signal and the second scanning selection signal have mutually opposite voltage polarities at a particular phase with respect to the voltage level of a scanning nonselection signal.

12. In a liquid crystal apparatus, comprising scanning electrodes and data electrodes intersecting each other to form a pixel at each intersection, a liquid crystal assuming a first optical state and a second optical state according to the polarity of a writing voltage applied thereto and disposed between the scanning electrodes and data electrodes, scanning-side drive means connected to the scanning electrodes, the improvement wherein:

said scanning-side drive means includes means for supplying first and second scanning selection signals to the scanning electrodes, each of said first and second scanning selection signals having a voltage in a clear phase and a voltage in a write phase of mutually opposite polarities with respect to the voltage level of a non-selected electrode, the first and second scanning selection signals having voltages of mutually opposite polarities in each of the clear phase and the write phase with respect to the voltage level of a non-selected electrode, so that both the first and second scanning selection signals are applied to the scanning electrodes in one vertical scanning period, and a particular scanning electrode is supplied with both the first and second scanning selection signals in a first and a second vertical scanning period;

said data-side drive means includes means for supplying data pulses to the data electrodes in synchronism with the first and second scanning selection signals;

said scanning-side drive means and data-side drive means, in combination, (i) in the first vertical scanning period, applying to a first selected signal on a first scanning electrode a clearing voltage in the clear phase and then a first writing voltage so as to cause the first selected pixel to assume the first optical state in response to receiving the first scanning selection signal, and applying to a second selected pixel on a second scanning electrode a clearing voltage in the clear phase and then a second writing voltage so as to cause the second selected pixel to assume the second optical state in response to receiving the second scanning selection signal, and (ii) in the second vertical scanning period, applying a clearing voltage in the clear phase and then a first non-writing voltage of an opposite polarity to the first writing voltage to the first selected pixel on the first scanning electrode in response to receiving the second scanning selection signal, and applying a clearing voltage in the clear phase and then a second non-writing voltage of an opposite polarity to the second writing voltage to the second selected pixel on the second scanning electrode in response to receiving the first scanning selection signal.

13. A liquid crystal apparatus according to claim 12, wherein the liquid crystal is a ferroelectric liquid crystal.

14. A liquid crystal apparatus according to claim 12, wherein the liquid crystal is a chiral smectic liquid crystal.

15. A liquid crystal apparatus according to claim 14, wherein said chiral smectic liquid crystal is disposed in a layer sufficiently thin to release its helical structure in the absence of an electric field.

16. A liquid crystal apparatus according to claim 12, wherein said clear phase has a longer duration than said write phase.

17. A liquid crystal apparatus according to claim 12, wherein the first scanning electrode is an odd-numbered one and the second scanning electrode is an even-numbered one.

* * * * *

UNITED STATES PATENT AND TRADEMARK OFFICE

CERTIFICATE OF CORRECTION

PATENT NO. : 5,182,549 Page 1 of 2

DATED : January 26, 1993

INVENTOR(S) : OSAMU TANIGUCHI, ET AL.

It is certified that error appears in the above-indentified patent and that said Letters Patent is hereby corrected as shown below:

COLUMN 2

Line 49, "wherein" should read --wherein,--.
Line 63, "wherein" should read --wherein,--.

COLUMN 6

Line 34, "  denotes" should read --● denotes--.

COLUMN 8

Line 11, "wherein" should read --wherein,--.

COLUMN 10

Line 16, "back ground" should read --background--.
Line 21, "unvessary" should read --unnecessary--.
Line 27, "scaare" should read --scan are--.
Line 30, "to" should read --by--.

UNITED STATES PATENT AND TRADEMARK OFFICE

CERTIFICATE OF CORRECTION

PATENT NO. : 5,182,549

DATED : January 26, 1993

INVENTOR(S) : OSAMU TANIGUCHI, ET AL.

It is certified that error appears in the above-indentified patent and that said Letters Patent is hereby corrected as shown below:

COLUMN 14

Line 15, "platted" should read --plotted--.

COLUMN 15

Line 67, "an even-num-" should read --an odd-numbered one and the second scanning electrode is an even-num- --.

COLUMN 16

Line 20, "electrodes, the" should read --electrodes, and data-side drive means connected to the data electrodes, the--.

Signed and Sealed this

Thirtieth Day of August, 1994

Bruce Lehman

*Attest:*

*Attesting Officer*

BRUCE LEHMAN

*Commissioner of Patents and Trademarks*